US005610599A

United States Patent [19]

Nomura et al.

[11] Patent Number: 5,610,599

[45] Date of Patent: Mar. 11, 1997

[54] SYSTEM FOR TRAFFIC SIGNALS FOR ONE-SIDE PASSING

[75] Inventors: Toshimitsu Nomura; Akira Sato, both of Niigata; Minoru Ishizaki, Kamoshi; Kaoru Takeda, Niigata; Kazuhiko Yasui, Yachimata, all of Japan

[73] Assignee: Nihon Samicon Co. Ltd., Niigata-ken, Japan

[21] Appl. No.: 430,193

[22] Filed: Apr. 27, 1995

[30] Foreign Application Priority Data

Apr. 28, 1994 [JP] Japan ..... 6-091775
Oct. 20, 1994 [JP] Japan ..... 6-255551

[51] Int. Cl.[6] ..... G08G 1/097

[52] U.S. Cl. ..... 340/931; 340/916; 340/917; 340/923; 340/907; 340/908

[58] Field of Search ..... 340/920, 921, 340/922, 923, 907, 908, 916, 917; 364/436, 437

[56] References Cited

U.S. PATENT DOCUMENTS

| | | | |
|---|---|---|---|
| 3,522,581 | 8/1970 | Clark et al. | 340/921 |
| 4,433,324 | 2/1984 | Guillot | 340/921 |
| 5,252,969 | 10/1993 | Kishi | 340/908 |

FOREIGN PATENT DOCUMENTS

| | | | |
|---|---|---|---|
| 1076926 | 7/1967 | England | 340/921 |
| 50-13120 | 5/1975 | Japan . | |
| 55-31675 | 7/1980 | Japan . | |
| 64-27798 | 2/1989 | Japan . | |
| 3-62198 | 3/1991 | Japan . | |
| 5-40897 | 2/1993 | Japan . | |
| 5-35961 | 6/1993 | Japan . | |
| 6-4565 | 4/1994 | Japan . | |

*Primary Examiner*—Jeffery Hofsass
*Assistant Examiner*—Ashok Mannava
*Attorney, Agent, or Firm*—Quarles & Brady

[57] ABSTRACT

A system for traffic signals for one-side passing, which realizes efficient traffic control during abnormal operation of detectors or the night with little traffic density. Traffic signals 6 and 7 are provided with detectors 8 and 9 for detection of passing of vehicles respectively. Both traffic signals repeat traffic lighting in a cycled manner such as green-red, red-red, red-green and red-red by a sensitive controller 10. Owing to an ill-detection switching device 71, if there is no detection signal input by the detector of one traffic signal within a switch holding time after detection signal is input by the detector of the other traffic signal, the green lighting of one traffic signal will be shifted to a fixed-cycle operation until detection signal input by the detector. The traffic signal shifted to the fixed-cycle operation will be restored to the sensitive operation if the detection signal is input by the detector.

4 Claims, 21 Drawing Sheets

SYSTEM FOR TRAFFIC SIGNALS FOR ONE-SIDE PASSING

BACKGROUND OF THE INVENTION (a) Field of the Invention

The present invention relates to a system for traffic signals for one side passing, having two-position signal temporarily provided at both ends of a road section under construction.

(b) Description of Prior Art

Generally, in the event that vehicles alternately pass a one-side road section under construction from opposite directions, traffic signals are temorarily provided at both ends of the section, thereby conducting a traffic control. One of the representative of such prior art is disclosed, for example, in Japanese Patent Appln Laid-Open No. 3-62198, wherein at both ends of the section are provided traffic signals and detector means such as pressure sensors for detection of the number of vehicles passing therethrough, thus extending the lighting time of green signals at the heavier traffic end. Likewise, there is disclosed a signal controller circuit in Japanese Utility Model Publication No. 55-31675, while there is also disclosed a signal device which changes indication of signals by means of vehicle detector means such as light sensor or the like provided adjacent the signals in Japanese Utility Model Appln Laid-Open No. 64-27798. Further, there is further disclosed a system for alternately switching traffic signals controller device in Japanese Patent Appln Laid-Open No. 5-40897, having a set of traffic signals which is so operated that while one traffic light at passage allowed end is green, the other traffic signal at no passage allowed end is red or against us and detector means for detection of vehicles passing through the section. Furthermore, there is also proposed a traffic signal device provided at both ends of a road section under construction in Japanese Patent Publication No. 50-13120.

However, according to the traffic signals controller device in Japanese Patent Appln Laid-Open No. 3-62198, as the device controls the lighting time of the traffic signal based on the numeric data concerning waiting vehicles, it is difficult to allow vehicles from opposite directions to efficiently pass the section to shorten the waiting time of vehicles. Further, according to any of the above prior art, the waiting time will become still comparatively long, thus easily causing a traffic jam when traffic density is distinctly large at one side than at the other side in the road repairing section.

In addition, according to the above prior art, as they employ sensitive systems for control of the lighting of the traffic signals based on the detection of vehicles by the detector means such as pressure sensor, light sensor or the like, the control systems for traffic signals will be damaged in case of troubles being caused in the detector means. Furthermore, as such signal systems are usually still in operation even at night when no vehicles are found, there will sometimes be no input of detection signals for more than a preset time. In such case, you cannot conclude merely from the fact of no traffic that the detector means are out of order. Additionally, according to the above prior art, vehicles from the opposite directions will be exposed to great danger of head-on collision in the case that a vehicle enters the section against a red signal immediately after the change to red from green, while another vehicle also enters the section because of the signal change to green from red before the passing of the opposite vehicle.

SUMMARY OF THE INVENTION

Accordingly, it is a main object of the present invention to provide a system for traffic signals for one-side passing which can reduce the waiting time of vehicles and allow them to efficiently pass a road section under construction.

It is another object of the present invention to provide a system for traffic signals for one-side passing which can ensure the safety passage by vehicles in the road section at the time of signal changes.

It is also an object of the present invention to provide a system for traffic signals for one-side passing which can allow vehicles to efficiently pass the section even in the case of trouble in detector means and the night having less traffic density.

It is further an object of the present invention to provide a system for traffic signals for one-side passing which can allow vehicles entering the section immediately after the signal change from green to red to safely pass the section.

Additionally, it is further an object of the present invention to provide a system for traffic signals for one-side passing which can allow vehicles to safely and efficiently pass the section by shortening the uniformly red time of the signals in the case that vehicles do not pass the section immediately before the signal changes from green to red.

In accordance with a major feature of the present invention, there is provided a system for traffic signals for one-side passing comprising: two-position signals provided at both ends of a road reparing section through which vehicles from up lane and down lane alternately pass; detector means for detection of passage of vehicles which are provided at both ends of the road reparing section, each corresponding to each traffic signal; sensitive controller device for control of green or red lighting time and switching of red or green indication of the traffic signals based upon detection signals by the detector means, said sensitive controller means comprising: a lighting time setting means by which minimum and maximum green time of the traffic signals can be set; a lighting time controller means which extends green lighting time by unit extension time with input of detection signal concerning the vehicles within a switch holding time prior to lapse of the minimum green time, and further extends the green lighting time by each unit extension time up to the maximum green time with another input of detection signal within the unit extension time.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DESCRIPTION OF PREFERRED EMBODIMENTS

Figure 1:
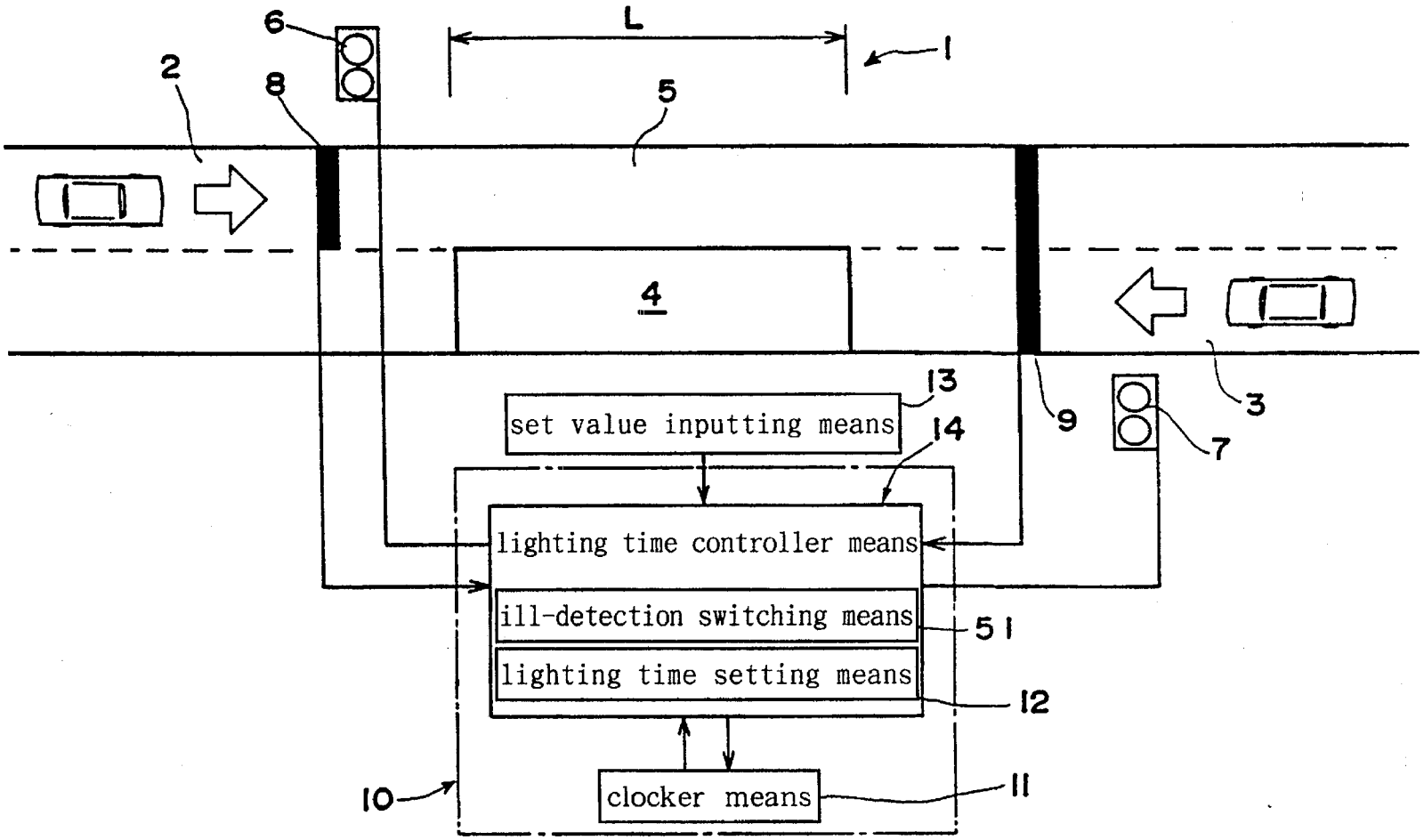
FIG. 1 is an explanatory plan view and diagram showing a first embodiment of the invention.

Hereinafter is described a first embodiment of the present invention with reference to FIGS. 1 to 11.

In FIGS. 1 to 11 showing a first embodiment of the invention, reference numeral 1 generally designates a road, having two lanes such as up lane 2 and down lane 3, wherein the up lane 2 is assumed to be blocked because of road repairing 4, and vehicles from opposite directions are assumed to alternately pass road reparing section 5 of L meters where traffic is one-side controlled. At both ends of the road reparing section 5 are temporarily provided simplified traffic lights 6 and 7, which employ two-position signaling systems, each of which having switchable red and green signals, said red signals being capable of flash operation. Reference numerals 8 and 9 designate detector means which are provided at stop lines of up and down lanes 2,3 (not shown), correspoding to the traffic lights 6 and 7 respectively. The detector means 8 and 9 may be, preferably, any suitable sensors such as pressure sensor, light sensor or the like, thereby detecting the passage of vehicles to output detection signals.

Reference numeral 10 designates sensitive controller device which controls the lighting of red and green signals of the traffic lights 6 and 7 by means of the detection signals derived from the detector means 8 and 9. The sensitive controller device 10 is connected to each detector means 8,9 and signals 6,7 across electric cables, whereby the signals 6,7 are so cycled that one signal is green while the other red, one signal red while the other green, and both signals red (uniformly red). The sensitive controller device 10 comprises clocker device 11 such as timer for clocking the lapse of time and lighting time setting means 12. The lighting time setting means 12 comprises setting time input means 13 such as kee board or setting control as described hereinbelow, thereby optionallly setting minimum green time Tmin. which is common to the signals 6 and 7, maximun green time Tmax. which is changeable in the signals 6 and 7, uniform red time Tr. during which both signals 6,7 are red, switch holding time Tk. as described hereinbelow, and unit extension time Te. respectively, all of which are memorized by the lighting time setting means 12.

More specifically, the minimun green time Tmin. is the time or hour during which signals 6 or 7 continues to be in green regardless of the detection signals concerning vehicles, while the maximun green time Tmax. is the time or hour after expiration of which the signals 6,7 must be changed to red from green. Likewise, the switch holding time Tk. is preset time or hour before the expiration of the minimun green time Tmin., while the unit extension time Te. is the time or hour by which the green time is extended after passage of vehicles based on the detection signals cencerning vehicles.

The uniform red time Tr. can be obtained by the following equation:

$$Tr.=L/Vave.$$

wherein Vave.is an average velocity of vehicles passing the road reparing section 5. Tr.is obtained by dividing L or the length of the section 5 by average velocity 5.6 m/sec., assuming that vehicles generally pass the section 5 at a speed of 20 km/hour, thereby setting Tr. at an average time or hour taken for vehicles to completely pass through the section 5.

Further, the sensitive controller device 10 further comprises lighting time controller means 14 for control of the lighting time of the red and green signals of the signals 6,7. The lighting time controller 14 is operated in the following manner:

If the detection signals concerning vehicle are input by the detector means 8 prior to the lapse of the minimun green time Tmin. within the switch holding time Tk. equal to the unit extension time Te., the lighting time of the green signal of the traffic signal 6 is extended by the unit extension time Te. If there are no input of detection signals concerning vehicle during the unit extension time Te., which means there are no traffic during the period, the traffic signal 6 changes to red, while if there are some inputs thereof during the period, the lighting time of the green signal is further extended by the unit extension time Te., which can be extended up to the maximun green time Tmax., where the traffic signal 6 must be changed to red regardless of the remainder of the unit extension time Te., so that both traffic signals 6,7 will be in red. Upon expiration of the uniformly red time Tr., the other traffic signal 7 is changed to green, and the lighting time of green signal is controlled by means of the detection signals from the detector means 9 in the same manner as the above described.

The sensitive controller 14 further comprises uniformly red time automated learning calculator means 15 (hereinafter uniformly red automated learning means), wherein if the detector means is, for example, pressure sensor, the detector means 9 is provided across the entire width of road, while the detector means 8 provided across the up lane 2 thereof, whereby the detector means 8,9 can detect passage of vehicles from opposite directions. The uniformly red time automated learning means 15 clocks the time distance to allow the last vehicle to pass through the section 5 during the lighting of green signal at one end, based on the detection signals derived from detector means 8 and 9, thereby setting the uniformly red time Tr. for control of the system. The uniformly red time automated learing means 15 enables the setting and controlling of the uniformly red time Tr. without use of the lighting time setting means 12, wherein, for example, an average value of the time distance taken every thirty minutes may be the uniformly red time Tr., which is input to the lighting time setting means 12, thus prolonging the uniformly red time Tr. during comparatively a heavy traffic time zone such as so-called the rush hour, and shortening the same during comparatively a light traffic time zone.

Furthermore, the sensitive controller 10 may be provided with self-decision function, which can automatically change the operation of the traffic signals 6,7 into fixed-cycle control operation to smoothly perform signal operation, in the event that there are any troubles such as disconnection in the detector means 8,9 or abonormal operation of traffic signals 6,7 such as uniformly green operation. Additionally, the sensitive controller may detect the burn-out of electric bulbs of the traffic signals 6,7, thus performing a control operation to produce an alarming sound by means of alarming means (not shown).

Figure 2:
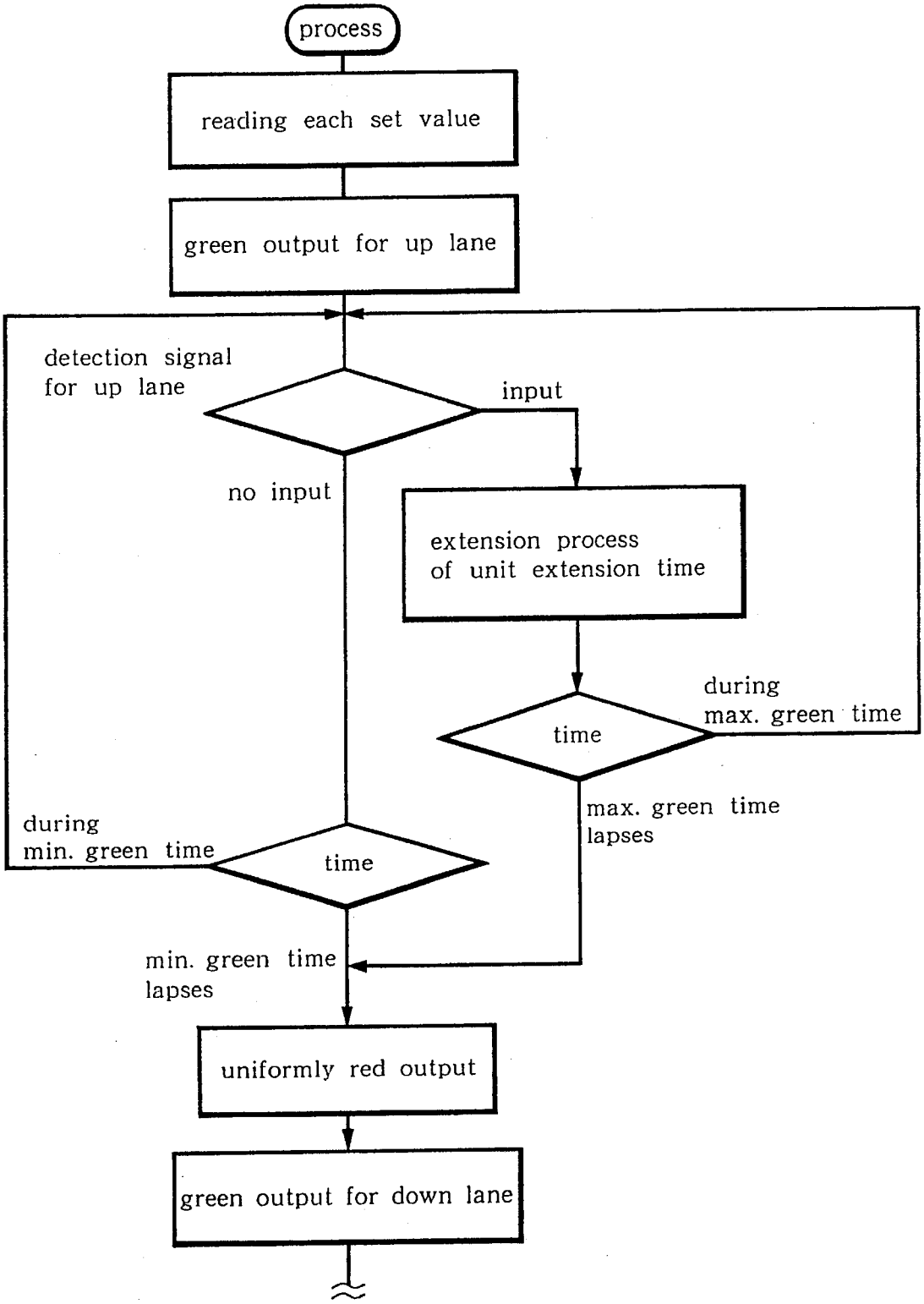
FIG. 2 is a flow chart showing a first embodiment of the invention.

Hereinafter is described an example of control operation of traffic signals 6,7 by means of the sensitive controller device 10 with reference to flow chart shown in FIG. 2.

When the detection signals concerning vehicles are input in the sensitive controller device 10 during the minimum green time Tmin. across the detector means 8, the lighting time of the green signal is extended by the unit extension time Te.as "Input" shown in the flow chart, which is further extended up to the maximun green time Tmax. at miximun. In the case of "No Input", the traffic signals 6,7 are changed to uniformly red after lapse of the minimun green time Tmin.

Figure 3:
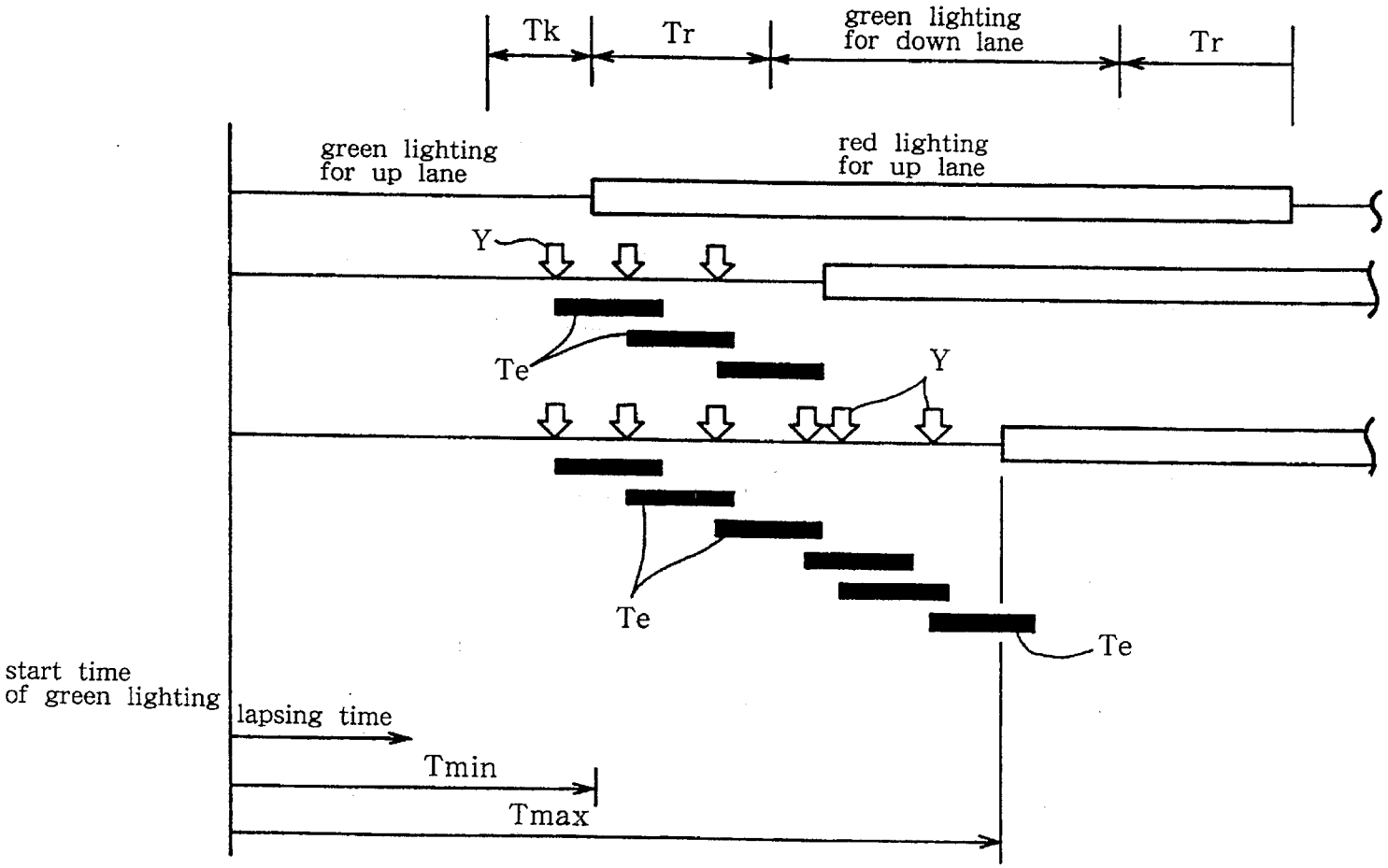
FIG. 3 is a diagrammatic view showing a system for a first embodiment of the invention.

FIG. 3 is a time line diagram wherein axis of abscissa is time-axis for explanation of the lapse of time and lighting time of the traffic signals 6,7. Arrow Y designates input of detection signals from the detector means 8.

For upper time zone, if there are no input of detection signals within the switch holding time Tk., the green time zone changes to uniformly red time zone Tr.after lapse of the minimum green time Tmin.

Whilst, for intermediate time zone, if there are input of detection signals within the swith holding time Tk. before the lapse of the minimum green time Tmin., the green time zone is further extended by the unit extension time zone Te.. Namely, as can be seen from the three arrows and three unit extension time zones shown in relation to the intermediate time zone, if the second detection signal illustrated by middle arrow is input during the first unit extension time due to the input of the first detection signal illustrated by the left arrow, the lighting time of green signal is further extended by the unit time Te. from the time point of the second detection signal. If there are no input of the detection signal after the input of the third detection signal illustrated in the right arrow, the green time zone is changed to the uniformly red time zone Tr. after lapse of the unit time Te..

For lower time zone, where the green time is further extended up to the maximum green time Tmax. by the subsequent detection signals, the green time zone is changed to red time zone regardless of the remainder of the unit time Te. caused by the sixth detection signal. With the system thus described, control of the traffic signals 6 and 7 can be optimized, corresponding to varying degree of passage of vehicles. The lighting time of green signal for down lane can be controlled in the same manner as described above.

According to the above system for traffic signals for one-side passing, the green signals of the traffic signals 6,7 are changed under the maximum green time Tmax after the minimum green time Tmin.. depending on the passage of vehicles during the unit time Te., whereby the green signals are switched if the passage of vehicles cease, and are controlled depending on the varying degree of the passage. Accordingly, even if there are different traffic density in the up and down lanes, the traffic jam occurring at one lane can be prevented, thus shortening the holding or waiting time and efficiently controlling the passage of vehicles from the up and down directions. Further, the detector means 8,9 have only to be provided near the road reparing section 5, for example in the stop lines thereof, and the wiring such as electric cables to connect to the sensitive controller 10 can be comparatively shortened, thereby resulting in low manufacturing cost of the system. In addition, as one cycle of the operation of the traffic signals changes depending on the varying degree of traffic density, you can be free from waste of time, thus efficiently controlling alternate one-side passage.

Figure 4:
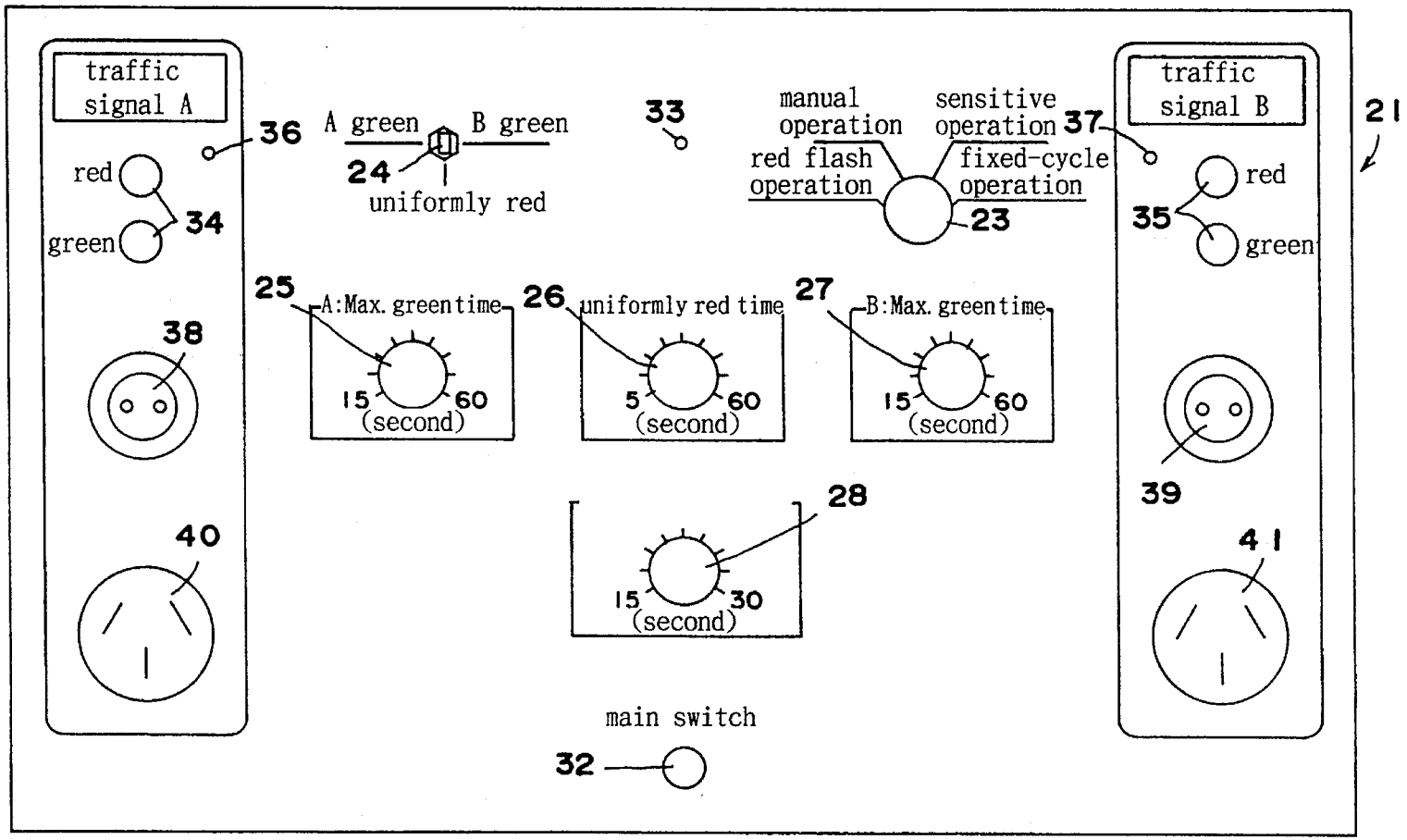
FIG. 4 is a front view showing an operation box of a first embodiment of the invention.
Figure 5:
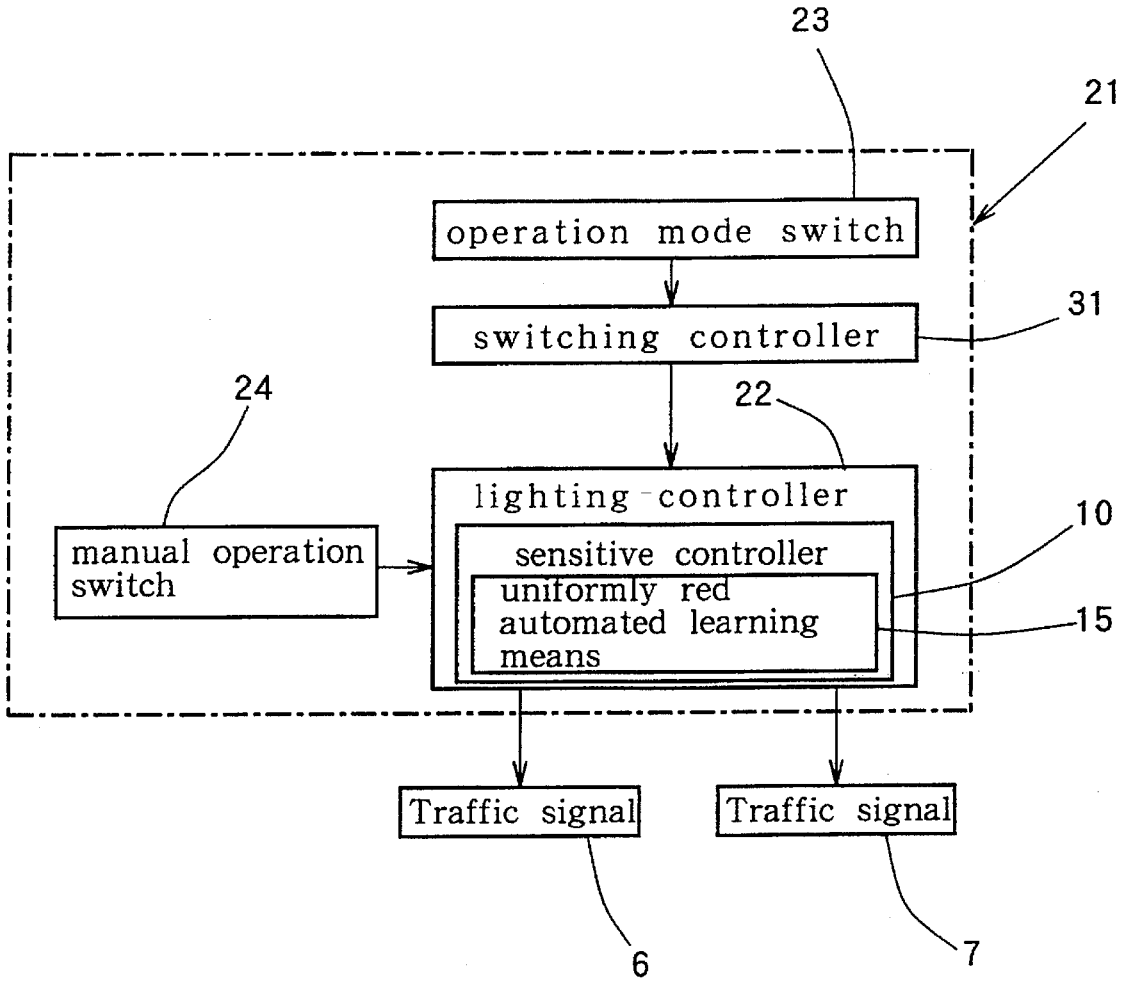
FIG. 5 is a block diagram showing a first embodiment of the invention.

In a preferred form of the invention, the sensitive controller 10 is housed in operation box 21 shown in FIG. 4, within which is provided lighting controller 22 having CPU or electric circuit for control of the lighting of the traffic signals 6,7. The sensitive controller 10 may be incorporated into a part of the lighting controller 22 as shown in FIG. 5, or alternatively, may be provided independently thereof.

The description described hereinbelow is related to the system within the operation box 21, wherein traffic signal A corresponds to the traffic signal 6 for up lane, while traffic signal B to the traffic signal 7 for down lane. The lighting controller 22 can perform simultaneous red flash operation of the traffic signals 6,7 by switching of operation mode switch 23 provided in front of the operation box 21, manual operation of red-green, red-red, green-red lightings of the traffic signals 6,7 by switching manual switch 24 in front of the operation box 21, fixed-cycle operation of the traffic signals 6,7, each cycle including green-red, red-red, red-green lightings in sequence for each preset period, thus switching the traffic signals 6,7 in association with the above four operation modes.

The lighting controller 22 is connected to the switches 23,24, whereby in manual operation mode with the use of the switching operation of the switch 23, the manual switch control 24 is laid down to "A-Green" side in a switch indication line so that the traffic signal 6 changes to green while the traffic signal 7 to red. Likewise, both the traffic signal 6 and 7 change to red when the manual switch control 24 is positioned intermediately, while the manual switch control 24 is laid down to "B-Green" side in the switch indication line so that the traffic signal 6 changes to red while the traffic signal 7 to green. At this time, by tuning of lighting time setting controls provided in front of the operation box 21, each green lighting time and the uniformly red (red-red) lighting time of the traffic signals 6,7 can be determined, while by operation of the operation mode switching control 23, which is also provided in front of the operation box 21, the four operation modes, i.e., red flash, manual, sensitive and fixed-cycle operation modes can be switched.

Referring to FIG. 4, the operation mode switching control 23 is turned to each position corresponding to "red flash", "manual", "sensitive" or "fixed-cycle" so that the operation modes of the traffic signals 6,7 can be changed to red flash, manual, sensitive and fixed-cycle operation respectively.

Preferably, the above-mentioned lighting time setting controls comprises: maximum green time setting control 25 positioned in an upper-left side of FIG. 4, said control 25 setting green lighting time of the traffic signal 6 in fixed-cycle mode; uniformly red time setting control 26 positioned in an upper-intermediate side thereof, said control 26 setting uniformly red lighting time of the traffic signal 6 in fixed-cycle mode; maximum green time setting control 27 positioned in an upper-right side of thereof, said control 27 setting green lighting time of the traffic signal 7 in fixed-cycle mode; minimum green time setting control 28 positioned in a lower side thereof, said control 28 setting minimum green lighting time of the traffic signals 6 and 7.

In the above fixed-cycle operation mode, each set value obtained by tuning the maximun green time controls 25,27 will be each preset green lighting time of the traffic signals 6,7 for up and down lanes, where the time setting controls 25 to 28 are used as the aforesaid setting time input means 13. Namely, the operation mode switch 23 is turned to "sensitive" mode, and then, the controls 25 to 28 are desirably tuned, thereby setting the maximum green time Tmax. for the traffic signal. 6, the uniformly red time Tr., the maximum green time Tmax. for the traffic signal 7 and the minimum green time Tmin. for both the traffic signals 6 and 7 respectively. Based on the above-set Tmax., Tr., Tmax and Tmin., the sensitive controller 10 controls the above-described sensitive operation of the traffic signals 6 and 7.

As described above, the present invention is related to a system for traffic signals in which the operation of the operation mode switch 23 enables the switching of four operation modes including red-flash, manual, fixed-cycle and sensitive operation modes of the traffic signals 6 and 7.

Referring to FIG. 5, reference numeral 31 designates switching controller 31 within the operation box 21. The switching controller 31 comprises CPU, certain electric circuit or the like, which may be incorporated into the lighting controller 22. The switching controller 31 can control the shifting of the operation modes of the traffic signals 6,7 when the operation modes are changed to those by the lighting controller 22 or sensitive controller 10 by means of the operation mode switch 23. The controlling details are explained in Table 1 shown below:

TABLE 1

| | after shifting | | | |
|---|---|---|---|---|
| operation | red flash operation | manual operation | sensitive operation | fixed-cycle operation |
| before shifting | | | | |
| red flash operation | — | Manual operation after execution of uniformly red. | Sensitive operation after execution of uniformly red. | Fixed-cycle operation after execution of uniformly red. |
| manual operation | Red flash operation after execution of uniformly red. | — | Sensitive operation after execution of uniformly red. | Fixed-cycle operation after execution of uniformly red. |
| sensitive operation | Red flash operation via uniformly red after execution of min. green Uniformly red operation if green time exceeds the min. green. | Manual operation via uniformly red after execution of min. green. Uniformly red operation if green time exceeds the min. green. | — | Fixed-cycle operation via uniformly red after execution of min. green. Uniformly red operation if green time exceeds the min. green. |
| fixed-cycle operation | Red flash operation via uniformly red after execution of max. green. | Manual operation via uniformly red after execution of max. green. | Sensitive operation via uniform red after execution of max. green. | — |

Hereinafter is described the control by means of the switching controller 31 with reference to Table 1.

In the red-flash operation mode shown in an upper or first row of Table 1, the mode is changed to another mode after execution of uniformly red (red-red) lighting of the traffic signals 6 and 7 for the uniformly red time Tr. set by the uniformly red time setting control 26. In the manual operation mode shown in the second row thereof, the mode is changed to another mode after execution of uniformly red lighting of the traffic signals 6 and 7 for the uniformly red time Tr. irrespective of any lighting indication thereof at that time. In the event that the traffic signals 6 and 7 are in the uniformly red operation at the time of operation by the operation mode switch 23, the mode is changed to another mode after execution of uniformly red lighting for the preset uniformly red time Tr. after switching by the operation mode switch 23.

In the fixed-cycle operation mode shown in a lower or fourth row thereof, being referenced on the green lighting of one traffic signal, the mode is changed to another mode via execution of uniformly red lighting for the uniformly red time Tr. after lapse of the maximun green time Tmax. for the traffic signal. In the event that the traffic signals 6 and 7 are in the uniformly red operation in the fixed-cycle operation mode prior to the switching by the operation mode switch 23, the mode is changed to another mode after execution of uniformly red lighting for the preset uniformly red time Tr. after switching by the operation mode switch 23.

Figure 6:
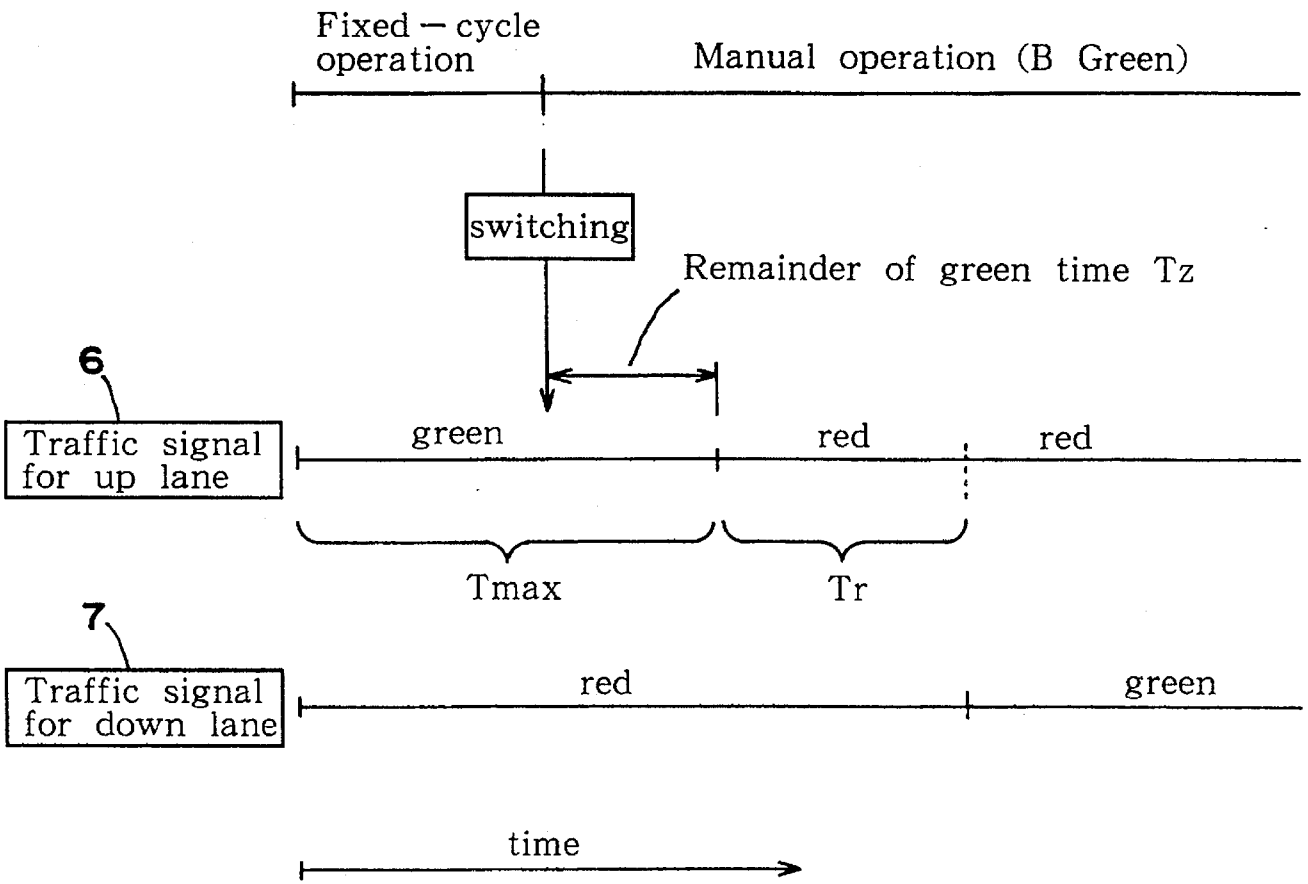
FIG. 6 is a time line diagram explaining switching from a fixed-cycle operation to a manual operation of a first embodiment of the invention.

In FIG. 6 showing a time line diagram explaining one example in which operation mode is being shifted from fixed-cycle to manual operation mode, wherein time generally flows from the left toward the right direction, and manual operation switch 24 is laid down to "B Green"(or "A Red") side in advance. If the fixed-cycle mode is changed to the manual mode at the time of the green lighting of the traffic signal 6 for the up lane, the traffic signal 6 will still remain green in spite of the above manual switching until the remainder Tz. of the preset maximun green time Tmax. lases, and then, both of the traffic signals 6,7 will be in red for the uniformly red time Tr. and finally, the traffic signal 6 will change to red while the traffic signal 7 to green as preset by the above manual switching.

Whereas, in the sensitive operation mode shown in the third row thereof, in the case of shifting to another mode, which being referenced on the green lighting of one traffic signal, if the green lighting time of the traffic signal is less than the minimum green time Tmin. preset therefor, the traffic signal still remains green as long as the minimum green lighting time for the traffic signal remains. After lapse of the minimum green time Tmin., both traffic signals 6 and 7 will be in red for the preset uniformly red time Tr., and thereafter the mode at that time will be changed to another mode. On the other hand, if the green lighting time of the reference traffic signal exceeds the minimum green time Tr., both traffic signals will immediately change to red, and then, after execution of uniformly red lighting for the preset uniformly red time Tr., the mode at that time will be changed to another mode. In the event that both traffic signals are red at the time of operation by the operation mode switch 23, the mode at that time will be changed to another mode via execution of the preset uniformly red time Tr. after the switching of the operation mode switch 23.

Referring again to FIG. 4, reference numeral 32 designates main switch for on-off control of electric system in the operation box 21. When the main switch 32 is on, in-operation lamp 33 provided on an upper side in the center of the operation box 21 is lighted. Reference numerals 34 and 35 are indicator lamps which display the lighting of the corresponding traffic signals 6 and 7, each having an upper red lamp and a lower green lamp. Reference numerals 36 and 37 designate sensor in-operation indicator lamps innerly adjacent the indicator lamps 34 and 35 for confirmation of the actuation of the corresponding detector means 8 and 9. Reference numerals 38 and 39 designate input terminals to connect to the electric cables of the detector means 8 and 9, while 40 and 41 designate output terminals to connect to electric cables between the traffic signals 6, 7 and the operation box 21. Hereinafter is detailedly described the operation of switching controller 31, which is one of the main features of the invention.

According to prior system, if the operation mode switch 23 is turned, for example, from manual mode where the traffic signal 6 is in red while the traffic signal 7 in green to fixed-cycle mode after turn-on of the main switch 32 to actuate each device, the traffic signals 6 and 7 would immediately inversely change, i.e., the traffic signal 6 green while the traffic signal 7 red. According to the invention, the switching controller 31 can control such instant inverse change of the traffic signals 6,7, so that both of them are changed to red simultaneously with the switching before the shifting to fixed-cycle mode, and then, via execution of the uniformly red lighting for the preset uniformly red time Tr., the mode is changed to fixed-cycle mode so that they are inversely changed, i.e., the traffic signal 6 green while the traffic signal 7 red.

Owing to the above switching controller 31 of the invention, though the traffic signals 6 and 7 would inversely change at the same time that the operation switch 23 would be changed, both traffic signals 6 and 7 can still remain red for the preset uniformly red time Tr., thereby allowing vehicles passing the road reparing section 5 to safely pass therethrough and successfully preventing vehicles from entering the section 5 from opposite direction.

Further, according to prior system, if the operation mode switch 23 is turned, for example, from fixed-cycle mode where the traffic signal 6 is in green while the traffic signal 7 in red to manual mode with the manual operation switch 24 laid down to the right, i.e., the traffic signal 6 red while the traffic signal 7 green, both signals 6 and 7 would instantly inversely change, i.e., the traffic signal 6 changes from green to red while the traffic signal 7 from red to green, thus causing some fear of head-on collision of vehicles allowed in the section 5 from the up lane due to the green signal with opposite vehicles also allowed therein due to the green signal after the switching. According to the invention, the switching controller 31 can suppress such instant inverse change of the traffic signals 6,7, so that both signals are temporarily changed to red, and then, via execution of the uniformly red lighting for the preset uniformly red time Tr., they are inversely changed, thereby allowing vehicles passing the road reparing section 5 to safely pass therethrough during the uniformly red time and successfully preventing vehicles from entering the section 5 from the opposite direction. Furthermore, according to prior system, if the operation switch 23 is turned from red-flash mode, where vehicles from both directions temporarily stop at the traffic signals 6 or 7, and then pass the section 5 after confirmation of safety passage, to another mode, one traffic signal would instantly change to green while the other to red, thus causing some fear of head-on collision of vehicles allowed in the section 5 due to the green signal with opposite vehicles which would have entered the same after the above confirmation. According to the invention, the switching controller 31 can control such instant change of the traffic signals 6,7, so that both of them are temporarily changed to red from red-flash, and then, the red-flash mode is changed to another mode via execution of the uniformly red lighting for the preset uniformly red time Tr., thereby allowing vehicles which had entered the section 5 during the red-flash time to safely pass therethrough during the uniformly red time and successfully preventing vehicles from entering the section 5 from the opposite direction owing to the control by the uniformly red lighting.

In addition, according to the invention, if the operation mode switch 23 is turned from sensitive mode to another mode, there is always intervened uniformly red lighting for the uniformly red time Tr. between the sensitive mode and another mode, whereby vehicles which had entered the section 5 due to the green signal can safely pass therethrough, and other vehicles from the opposite direction can be prevented from entering therein owing to the control by the uniformly red lighting. Besides, there is another advantage here such that since the traffic signals are changed to uniformly red after lapse of the minimum green time Tmin., passage of vehicles will not be blocked, adapting well to the traffic density at that time, thus smoothly switching the operation mode. Specifically, the sensitive mode is more effective for comparatively a large traffic density. For example, according to prior system, if shifted to another mode when drivers of vehicles expect to pass the traffic signal after two-times' green signals, the second green lighting time would distinctly become short, thus sometimes making the drivers get irritated and feel uneasy. According to the system of the invention, as the second green lighting time at least lasts for the minimum green time Tr., thereby decreasing the irriration and uneasiness of the drivers.

As described in the preceding paragraphs, the system for traffic signals of the invention can perform the sensitive operation based on the detection signals form the detector means 8 and 9. The controller device 10 has a function of smoothly guiding vehicles even in the event that there are certain malfunctions in the detector means 8 and 9, or there is less traffic density. for exmaple, at night.

Hereinbelow is described detail of the construction of the controller device 10.

The controller device 10 comprises ill-detection switching Leans 51 comprising: ROM for memorizing switch setting time Tc. which is input or set by switching time setting means (not shown) such as kee board (not shown) or any control like the above-described each setting control; lapsing time comparator means 52 wherein if detection signal is input from either the detector means 8 or 9 during the sensitive operation, lapsing time T is clocked by the clocker means 11, and then compared to the switch setting time Tch.; resetting means 53 by which the lapsing time T is cleared to Zero if the other detection signal is input after input of the innitial detection signal; return means 54 which controls the switching of the operation mode of the other traffic signal to the fixed-cycle mode after lapse of the switch setting time Tc. if the lapsing time T exceeds the switch setting time Tc, said return means 54 allowing the fixed-cycle mode of the other traffic signal to return to the innitial sensitive mode when the detection signal from the other detector means is input. Incidentally, the above-described switching controller 31 is actuated only in operation of the operation mode switch 23, not actuated while the ill-detection switching means 51 is in operation.

Hereinbelow is described controlling detail of the above ill-detection switching means 51 with reference to a block diagram of FIG. 7. The drawing is for explanation of the operation of the traffic signal 6 for up lane, therefore the operation of the traffic signal 7 for down lane can be explained in the same manner by replacing the wording "up lane" by "down lane".

The ill-detection switching means 51 can perform the following control of the traffic signals 6 and 7 operated by the sensitive operation.

Innitially, if the traffic signal 6 under the sensitive mode receives no detection signals from the other detectior means 9 for down lane, the sensitive mode will be maintained, while if it receives such detection signal from the detector means 9, the lapsing time T will be clocked until the detection signal from the detector means 8 for up lane is received, said lapsing time T being cleared or reset for usual case by the resetting means 53 after input of the detection signal for up lane.

Figure 7:
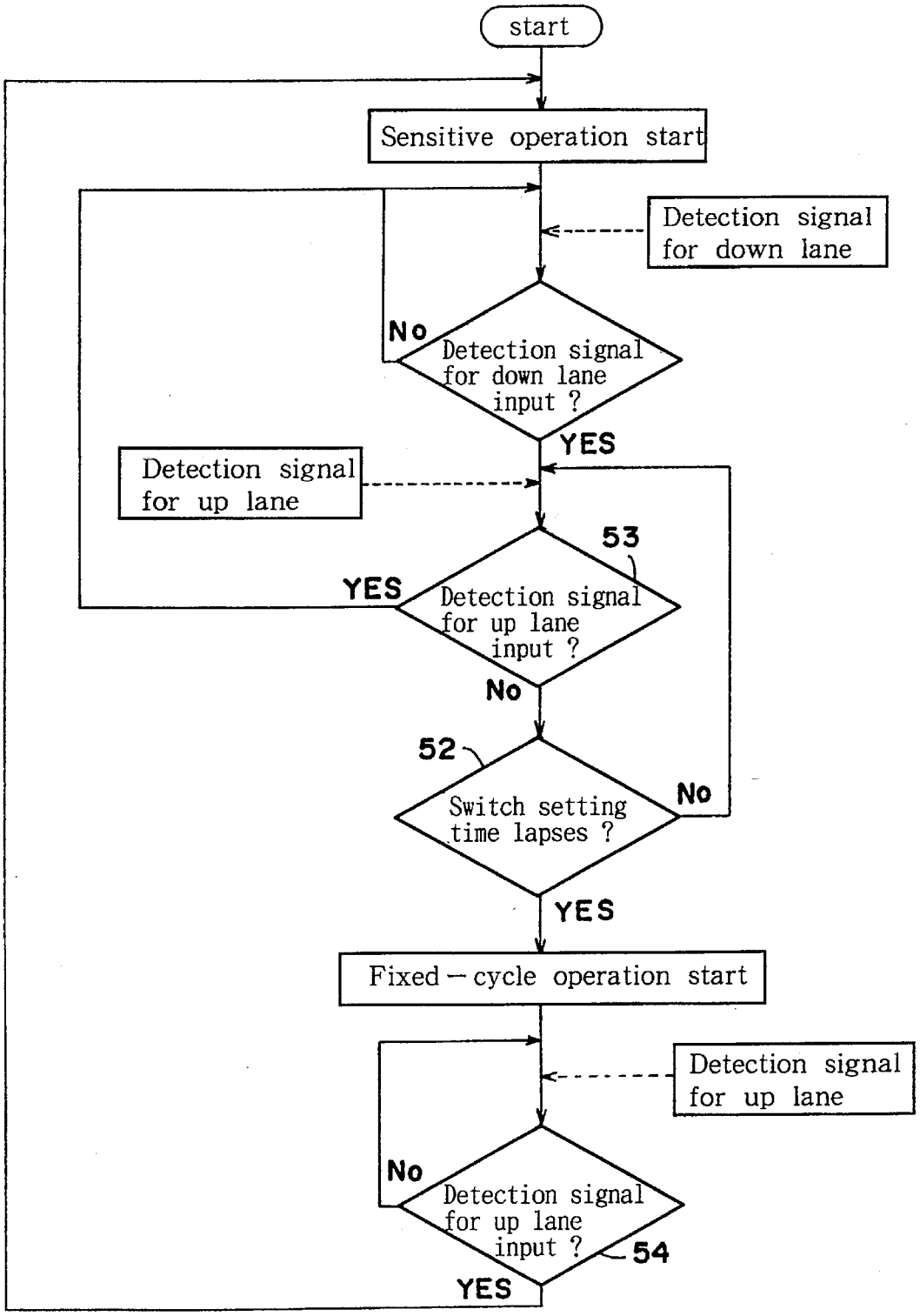
FIG. 7 is a flow chart showing an ill-detection switching means of a first embodiment of the invention.

Referring to FIG. 7, if the detection signal for down lane is input after the sensitive mode starts, the clocker means 11 clocks the lapsing time T, which is then compared to the switch setting time Tc. by the lapsing time comparator means 52. Unless the lapsing time T exceeds the switch setting time Tc., detection of the detection signal for up lane is repeated by the resetting means 53, while the traffic signal 6 for up lane is in the sensitive operation during the period. However, if the lapsing time T exceeds the switch setting time Tc. after input of the detection signal for down lane, the lapsing time comparator means 52 takes "YES" flow, thus shifting to fixed-cycle operation mode, making the traffic signal 6 start fixed-cycle operation.

This applies to such case that only the detector means 9 for down lane outputs the detection signal, wherein being no detection signals for up lane after lapse of the switch setting time Tc. is regarded as malfunction or trouble of the detector means 8 for up lane, whereby the ill-detection switching means 51 allows only the traffic signal 6 for up lane to be shifted to fixed-cycle operation mode, so that the green lighting time of the traffic signal 6 is set at average value of the maximum green time Tmax. and minimum green time Tmin. which are set in advance in the sensitive operation mode. However, in a time zone such as during the night when there is less traffic density, the lapsing time T sometimes exceeds the switch setting time Tc. without any malfuntion of the detector means 8. For such case, the ill-detection switching means 51 is actuated so that the traffic signal 6 changed to the fixed-cycle operation after lapse of the switch setting time Tc. resumes the sensitive operation when the detection signal for up lane is input, as shown in YES flow of the return means 54. The other traffic signal 7 for down lane can be switched by means of the ill-detection switching means 51 in the same manner as described above.

Figure 8:
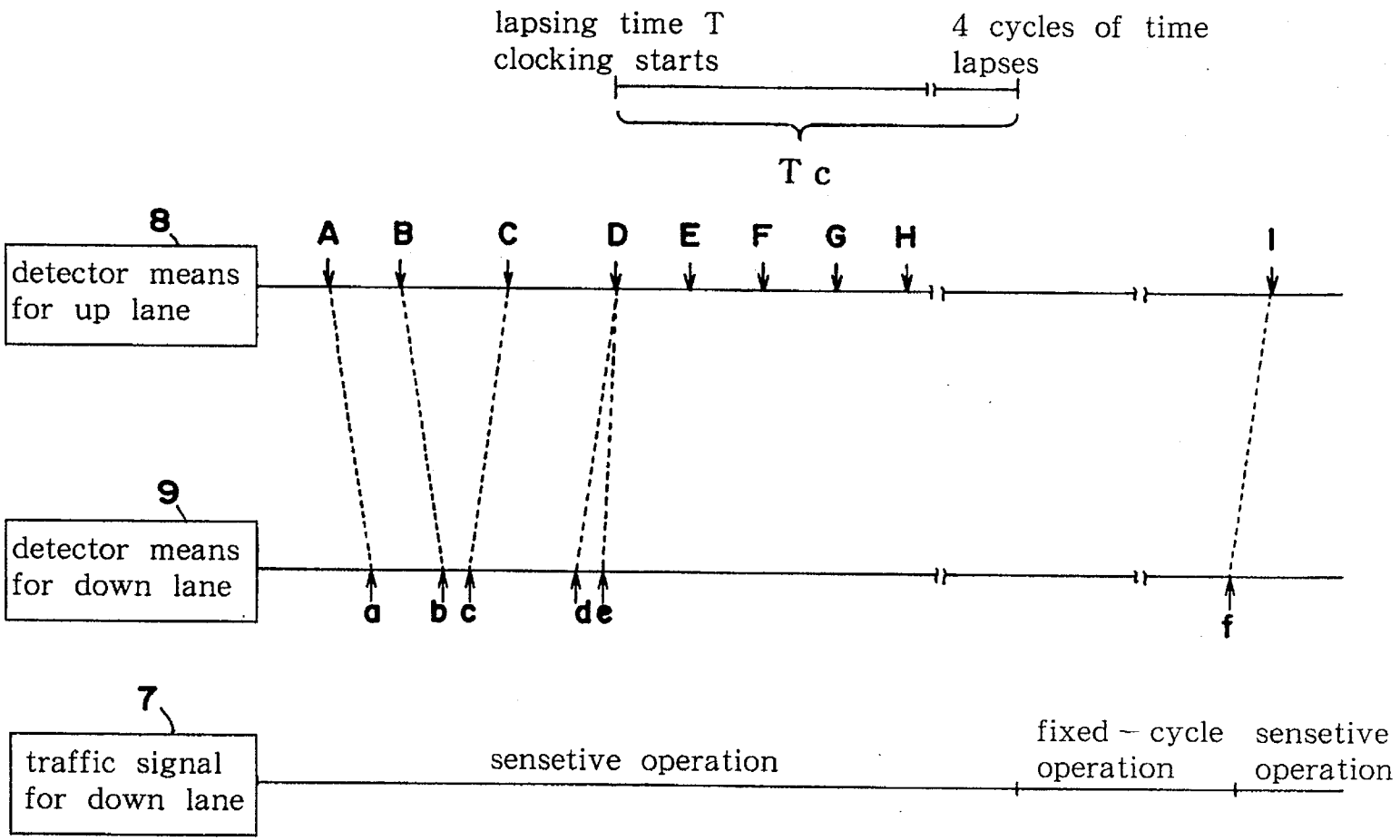
FIG. 8 is a time line diagram explaining an example of an actual operation of an ill-detection switching means of a first embodiment of the invention.
Figure 9:
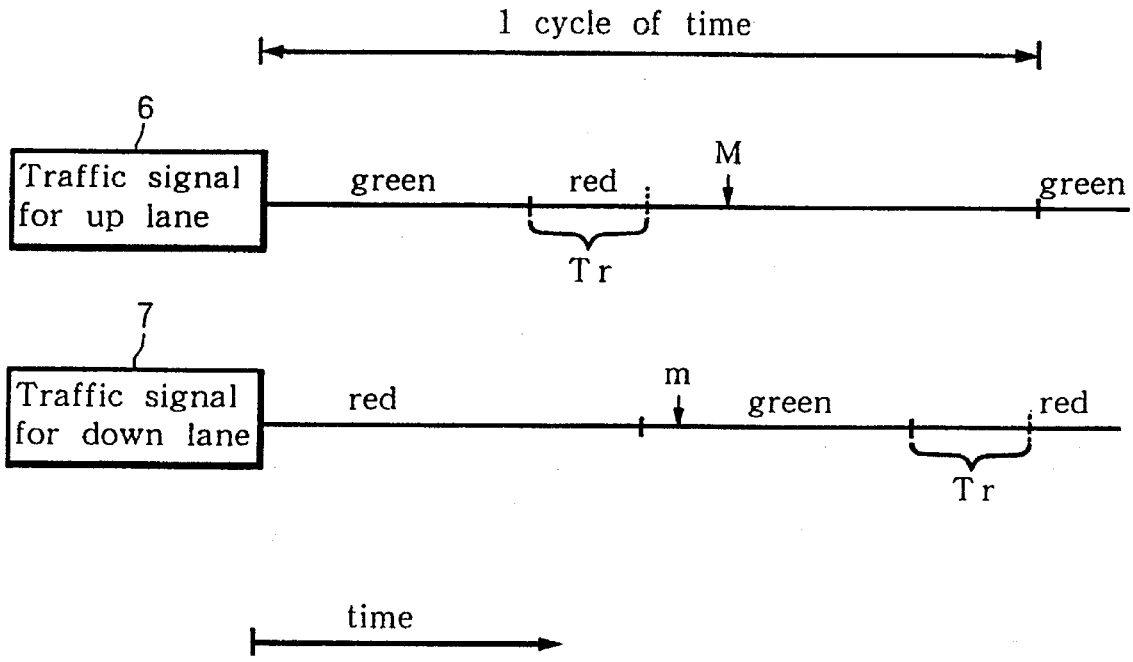
FIG. 9 is a time line diagram showing a one-cyle time of a first embodiment of the invention.

In FIG. 8 explaining the relationship between the lapse of time and the lighting of the traffic signal 7, wherein the horizontal axis is time axis. Small arrows A to I, a to f designate output of the detection signals from the detector means 8 and 9 respectively. In FIG. 8, the switch setting time Tc. is set at four cycles of time of the traffic signals 6 and 7, while in FIG. 9 a single cycle of time. As the single cycle of time is different in the sensitive operation than in the fixed-cycle operation by the ill-detection switching means 51, the green lighting time is set at average value of the miximum green time Tmax. and minimum green time Tmin., thus calculating the above single cycle of time. which is memorized by the ill-detection switching means 51 and compared to the lapsing time T. For example, assuming that the switch setting time Tc.is approximately half the single cycle of time, if the detection signal for down lane is input at small arrow "m" at nearly the same time that the traffic signal 7 for down lane changes to green, and subsequently another detection signal for up lane is input at small arrow "M" to start clocking of the lapsing time T as shown in FIG. 9, the traffic signal 6 will be possibly switched to fixed-cycle mode prior to the green ligthing thereof. Since such instant switching of mode is undesirable, the switch setting time Tc. should be at least more than the single cycle of time, which may be approximately as long as 10 cycles of time in the case of little traffic time zone such as the night. Taking the above circumstances into consideration, the switch setting time Tc. of the present embodiment is set at four cycles of time.

Referring again to FIG. 8, small arrows "A" and "a" indicate that vehicles from the up lane pass through the road reparing section 5 respectively, wherein the lapsing time T is clocked upon input of the detection signal of the arrow A, which is then cleared upon input of the detection signal of the other arrow a. Whilst, small arrows "C" and "c" indicate that vehicles from the down lane pass through the section 5, wherein the lapsing time T is clocked upon input of the detection signal of the arrow C, which is then cleared upon input of the other detection signal of the other arrow d. Likewise, the clocking which begins with the arrow b is cleared by the arrow C. Further, the clocking of the lapsing time independently begins with each input of the detection signals at arrows d and e, which are cleared by the input of the detection signal for up lane at arrow D.

If four cycles of time lapse with no input of detection signals for down lane after input of detection signal for up lane at arrow D, the traffic signal 7 for down lane is shifted to fixed-cycle mode, while the other traffic signal 6 for up lane maintaines the sensitive operation due to no clearing inputs corresponding to the arrow D. As described above, in the case that there are no inputs of detection signals for down lane if the switch setting time Tc. set at four cycles of time lapses after input of the detection signal for up lane, the traffic signal 7 for down lane will be shifted to fixed-cycle operation, which will be restored to the sensitive operation upon input of detection signal for down lane at arrow f of FIG. 8. As long as the detector means 9 for down lane is in abnormal operation, there is no detection signal output, therefore, the traffic signal 7 for down lane maintains the fixed-cycle operation.

Assuming that the operation of the traffic signals were switched based on the only information that input of detection signals stops, the traffic signal for up lane also would be shifted to the fixed-cycle operation, for example, at a time point between the arrow H and I of FIG. 8. According to the invention, in the event that there are no inputs of detection signals at the other traffic signal side for a predetermined period after input of detection signal at one traffic signal side, the other traffic signal will be shifted to the fixed-cycle operation, thus suppressing operation shift with the exception of such case as abnormal operation of the detector means. In addition, the system of the invention enables the smooth guiding of vehicles even if the detector means 8 and 9 cannot detect the travelling directions of vehicles, but detect the passage thereof only.

With the system thus made, owing to the ill-detection switching means 51 of the invention, the following advantages can be obtained: If the switch setting time Tc.longer than one cycle of time lapses after input of the last detection signal from the detector means 8 or 9, only the traffic signal opposite to the detector means which outputs the last detection signal is shifted to the fixed-cycle operation, which is maintained until another detection signal is input from the opposite detector means. Therefore, if the detection signal from one detector means is the last and thus a longer time than the switch setting time Tc.lapses with no detection signal from the opposite detector means, such state is regarded as malfuncton or trouble of the opposite detector means so that the opposite traffic signal is shifted to the fixed-cycle operation. If the opposite detector means is actually in abnormal operation, the above fixed-cycle operation enables the smooth guiding of vehicles, while if it is in normal operation and no input of detection signals are merely caused by accidental oversight or little traffic at that time, the opposite traffic signal shifted to the fixed-cycle operation is restored to the innitial sensitive operation when detection signal is input from the opposite detector means. Since there have been substantilly no passage of vehicles until the restoration, the fixed cycle operation of the opposite traffic signal will not prevent the passage of vehicles, thus efficiently allowing vehicles to pass the road repairing section 5 even in the case of such abnormal operation of the detector means 8 or 9, or little traffic.

Further, owing to the ill-detection switching means 51, the green lighting time of the traffic signal shifted to the fixed-cycle operation is set at an average value of the maximum green time Tmax. and the minimum green time Tmin. set in advance in the sensitive operation, whereby vehicles can be efficiently allowed to pass even in the case of the abnormal operation of the detector means. Furthermore, the switch setting time Tc. is set within a range from a single cycle of time to ten cycles thereof, preferably at four cycles of time, thereby smoothly guiding the passage of vehicles even during the night or a time zone with little traffic. Additionally, the uniformly red time automated learning calculator means 15 is provided such that the time distance for the last vehicle to pass through the section 5 is clocked based on the detection signals from both up and down lanes in order to set suitable uniformly red lighting time Tr., thereby automatically setting it by the means 15.

Moreover, owing to the switching controller 31, if the operation mode is changed to another mode by operation of the operation mode switch 23 with either the traffic signal 6 for up lane or the traffic signal 7 for down lane being in green, the green light still remains green for the remainder green time Tz. of the miximum green time Tmax., and thereafter, both traffic signals change to red. Accordingly, if the fixed-cycle operation mode is changed to another mode, the green light will not change to red immediately after the switching as long as the set maximum green time Tmax. remains, thereby preventing the disturbing of the passage of vehicles, and ensuring the safety one-side passing at the time of such operation switching.

In this case, if the operation mode is changed to the sensitive operation mode, such sensitive operation is executed after execution of the uniformly red lighting of both traffic signals for the uniformly red time Tr.. On the other hand, if the sensitive operation mode is changed to another mode, the green light still remains green until lapse of the minimum green time Tmin. in the case that the green lighting at that time is less than it, and then, both traffic signals change to red for the preset uniformly red time Tr. In the case that the green lighting time at that time exceeds the minimum green time Tmin., both traffic signals will immediately change to red and remain the same for the preset uniformly red time Tr.. Accordingly, in the case of mode switching from one operation mode to another mode, corresponding to the traffic density at that time, such mode switching is realized only after both traffic signals temporarily change to red irrespective of the operation modes prior to or after the change, and remain red for the preset uniformly red time Tr, thereby allowing vehicles passing the section 5 to safely pass therethrough during the time Tr. and preventing vehicles from entering the section 5 from the opposite direction, thus ensuring the safety one-side passing at the time of such mode switching. In addition, since the uniformly red time Tr. is set at average value of time distants generally necessary to allow vehicles to pass through the section 5, if some vehicles enter the section 5 immediately before the mode switching, they can safely pass therethrough during the Tr.

Figure 10:
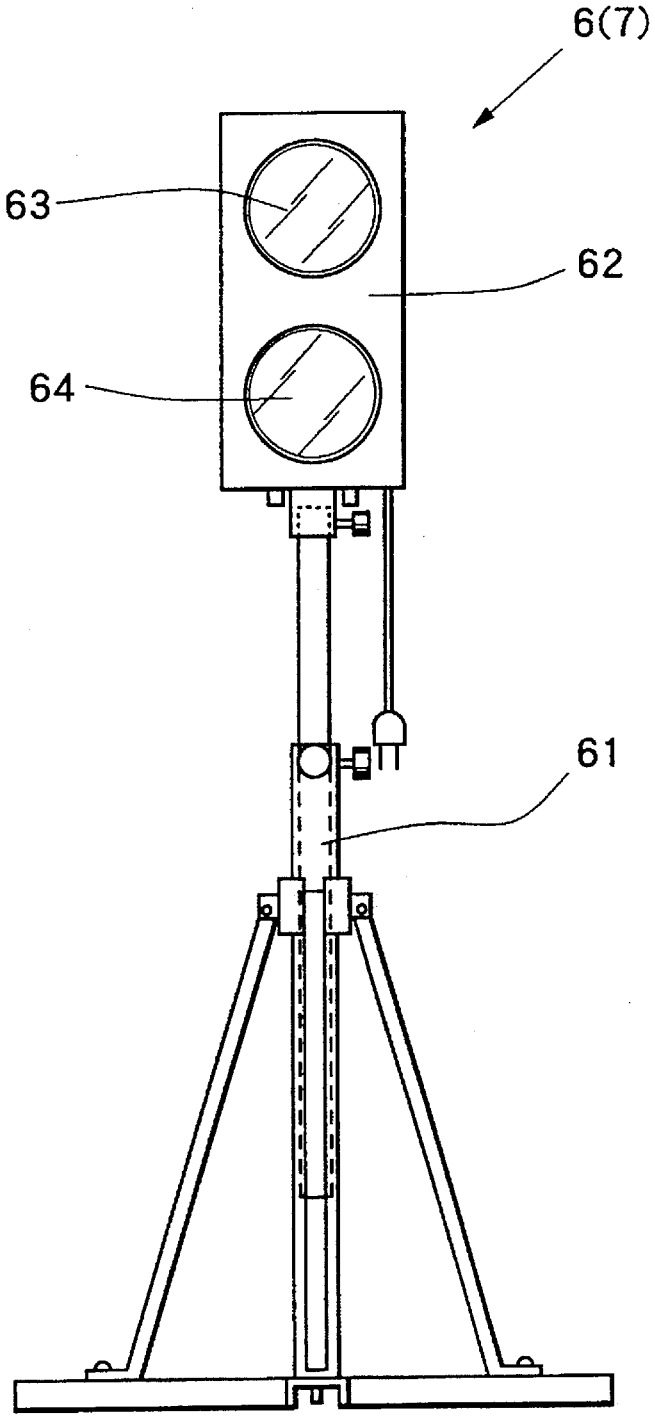
FIG. 10 is a front view showing a traffic light of a first embodiment of the invention.
Figure 11:
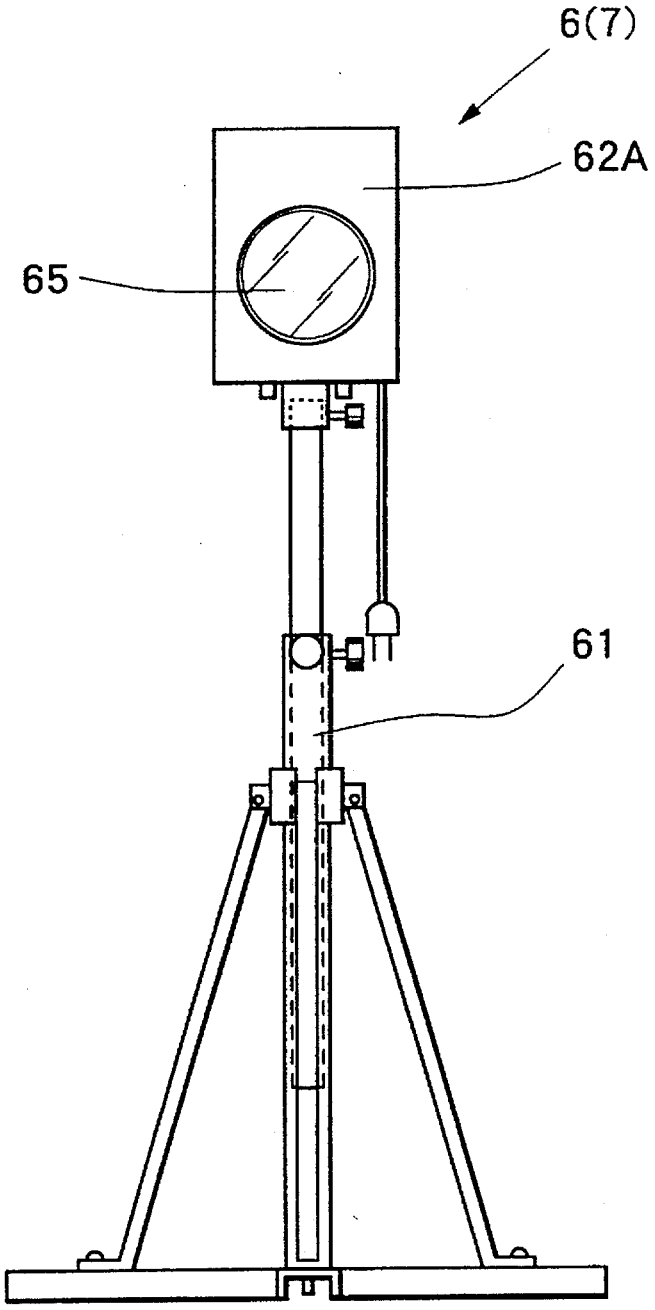
FIG. 11 is a front view showing another traffic light of a first embodiment of the invention.

In FIG. 10 showing a system for two-position traffic signals 6 and 7 of the invention, each traffic signal has main body 62 on supporting leg 61, said main body 62 having red lamp 63 and green lamp 64 at its front face. In FIG. 11 showing another system for two-position traffic signals 6 and 7 of the invention, each traffic signal has main body 62A on supporting leg 61, said main body 62A having switchable lamp 65 for red and green light. In FIGS. 12 to 16 showing a second embodiment of the invention, the same portions as those described in a first embodiment will be designated at common reference numerals, and their repeated detailed description will be omitted.

Figure 12:
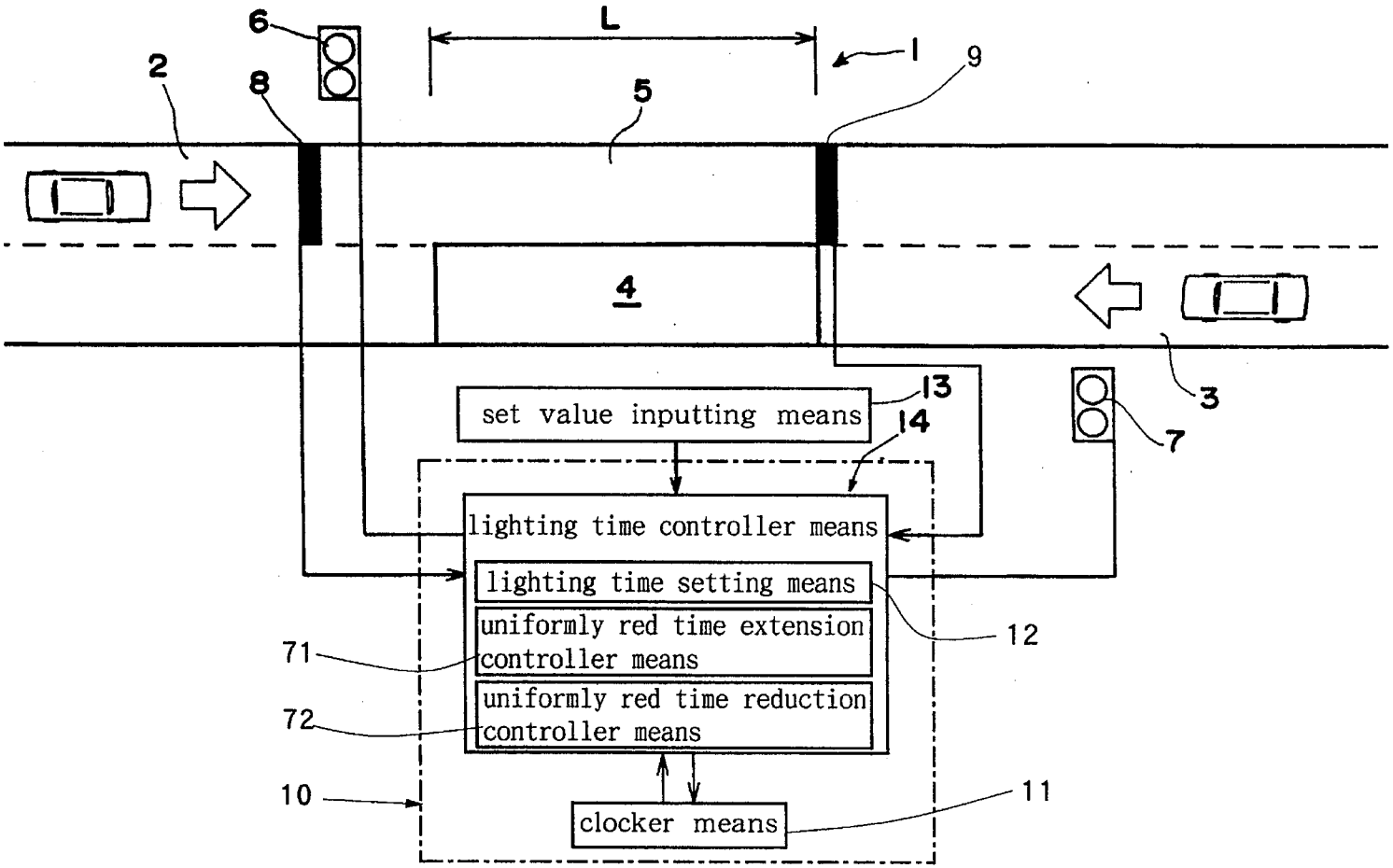
FIG. 12 is an explanatory plan view and diagram showing a second embodiment of the invention.

As shown in FIG. 12, the system of a second embodiment also comprises the sensitive controller device 10 having the lighng time controller 14. The system of a second embodiment further comprises uniformly red time extension controller means 71 and uniformly red time reduction controller means 72.

The uniformly red time extension controller 71 can perform the following control such that if detection signal by the detector means 8 or 9 of either the traffic signal 6 or 7 which actually switches from green to red by the lighting time controller 14 is input within preset detection time Tx. after the above actual switching from green to red, the uniformly red time Tr. for both traffic signals 6,7 is extended by the preset detection time Tx.; if either the traffic signal 6 or 7 switches from green to red within a time range from the minimum green time Tmin to the maximum green time Tmax., the clocker means 11 starts to clock the time Tx and if detection signal by the detector means 8 or 9 of either the traffic signal 6 or 7 which actually switches from green to red is input within preset detection time Tx., the uniformly red time Tr. for both traffic signals 6,7 is extended by the preset detection time Tx.

Whereas, the uniformly red time reduction controller 72 can perform the following control such that if detection signal by the detector means 8 or 9 of either the traffic signal 6 or 7 which actually switches from green to red by the lighting time controller 14 is not input within preset detection time Tx. after the above actual switching from green to red, the uniformly red time Tr. for both traffic signals 6,7 is reduced by the preset detection time Tx.; if either the traffic signal 6 or 7 switches from green to red within a time range from the minimum green time Tmin. but under the maximum green time Tmax., the clocker means 11 starts to clock the time Tx and if detection signal by the detector means 8 or 9 of either the traffic signal 6 or 7 which actually switches from green to red is not input within preset detection time Tx., the uniformly red time Tr. for both traffic signals 6,7 is reduced by the preset detection time Tx.; if either the traffic signal 6 or 7 remains green for the whole maximum green time Tmax. by the lighting time controller 14 and then it is switched to red, both means 71 and 72 do not work.

Hereinbelow is explained the switching control of the traffic signals 6 and 7 by the above means 71 and 72, with reference to explanatory diagrams of FIGS. 13 to 16, wherein the horizontal axis is time axis for explanation of the relationship between lapse of time and lighting of signals 6 and 7. Arrow Y designates input of detection signal from the detector means 8. Though the unit extension time Te. is equal to the preset detection time Tx in the drawings the former may be different from the latter, but they may be preferably longer or equal to the preset detection time Tx..

Figure 13:
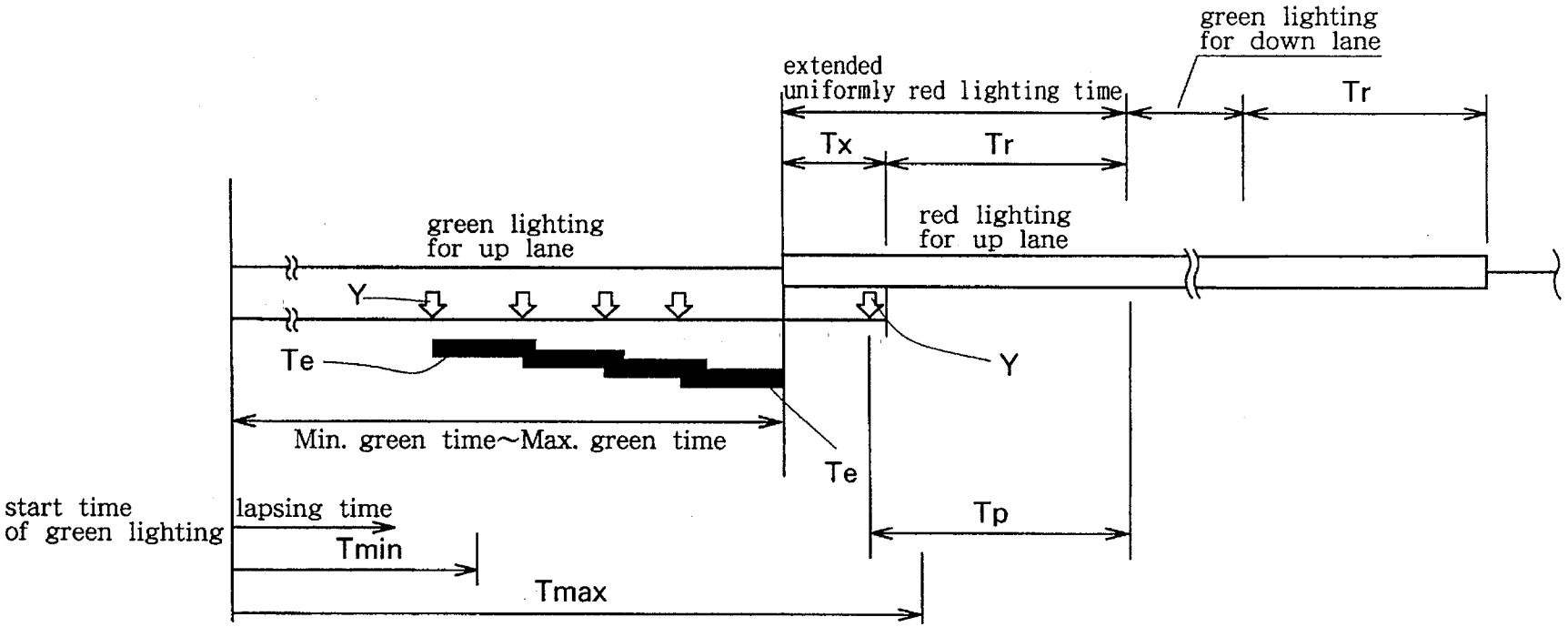
FIG. 13 is an explanatory diagram showing an extension of uniformly red time by means of a uniformly red time extension means of a second embodiment of the invention.

Referring to FIG. 13, it explains the switching control of the traffic signals 6 or 7 within a time range from the minimum green time Tmin. to the maximum green time Tmax. by means of the uniformly red time extension contoroler means 71.

With no input of detecton signal at the right arrow Y during the last unit extension time Te., the lighting time controller 14 changes the traffic signal 6 for up lane from green to red. Simultaneously with the switching, the clocking of the preset detecton time Tx. starts, and with another input of detection signal at arrow Y during the Tx., the uniformly red time Tr. is extended by the preset detection time Tx. by means of the uniformly red time extension means 71, thus executing the uniformly red lighting for the total time of the uniformly red time Tr. and the preset detection time Tx.. It should be noted here that the detection signal input within the preset detection time Tx. means that some vehicle has entered the section 5 immediately after the switching from green to red, ignoring the red light of the traffic signal 6. Owing to the uniformly red time extension controller 71, such vehicle can safely pass through the section 5 since the uniformly red time Tr. has been extended by the time Tx., so that time of grace Tp. shown in FIG. 13 for the last vehicle to pass through the section 5 can be longer than the Tr. by the extension of the uniformly red time Tr. by the Tx.. Further, with input of detection signal within the preset detection time Tx. even in the case of the swithing from green to red within the minimum green time Tmin or the maximum green time Tmax., the uniformly red time extension controller means 71 can extend the uniformly red time Tr. by the preset detection time Tx. as well, thereby allowing the vehicle which has entered the section 5 in spite of the red light to safely pass the same in the same manner.

Figure 14:
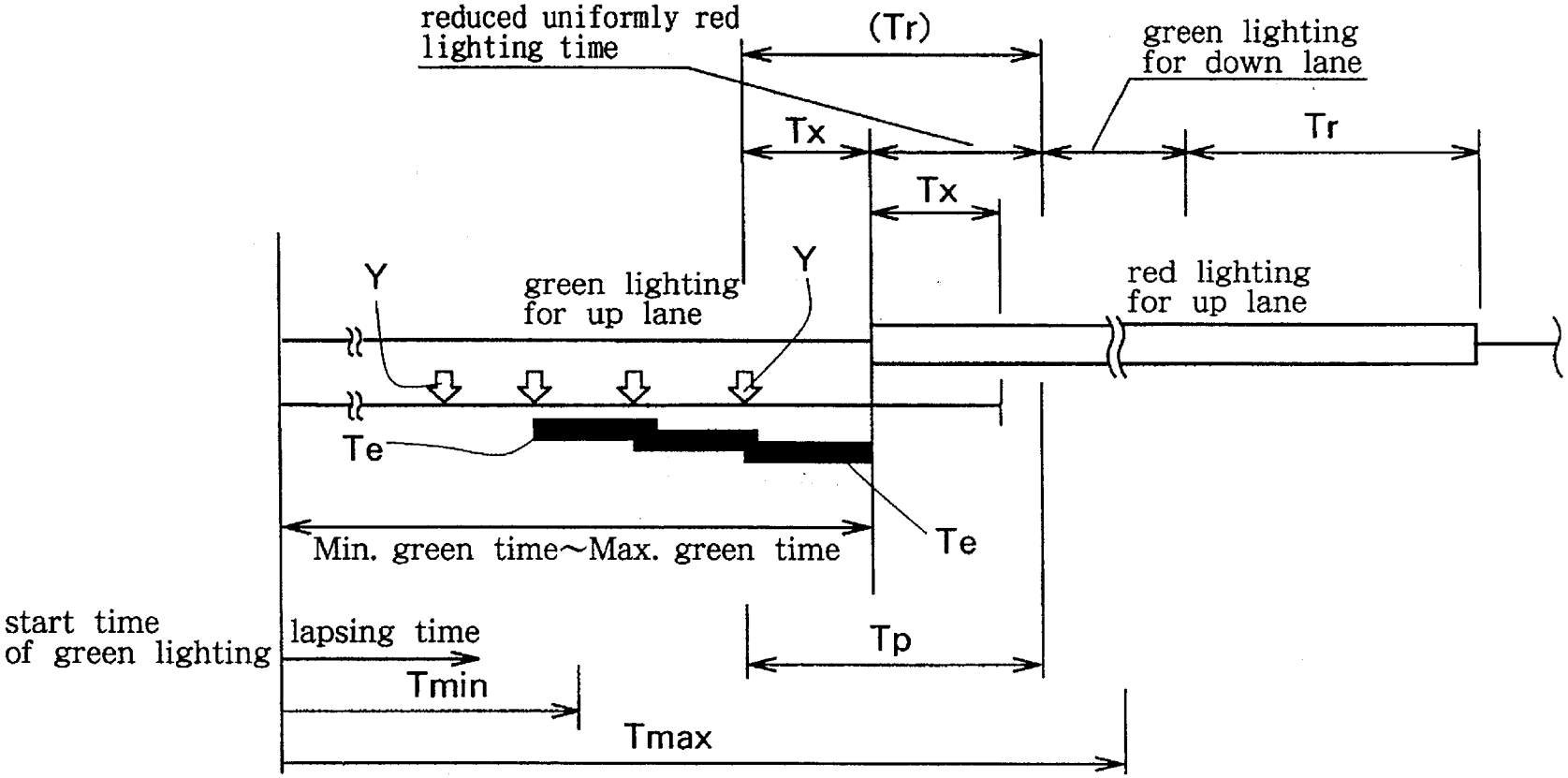
FIG. 14 is an explanatory diagram showing a reduction of a uniformly red time by means of a uniformly red time reduction means of a second embodiment of the invention.
Figure 15:
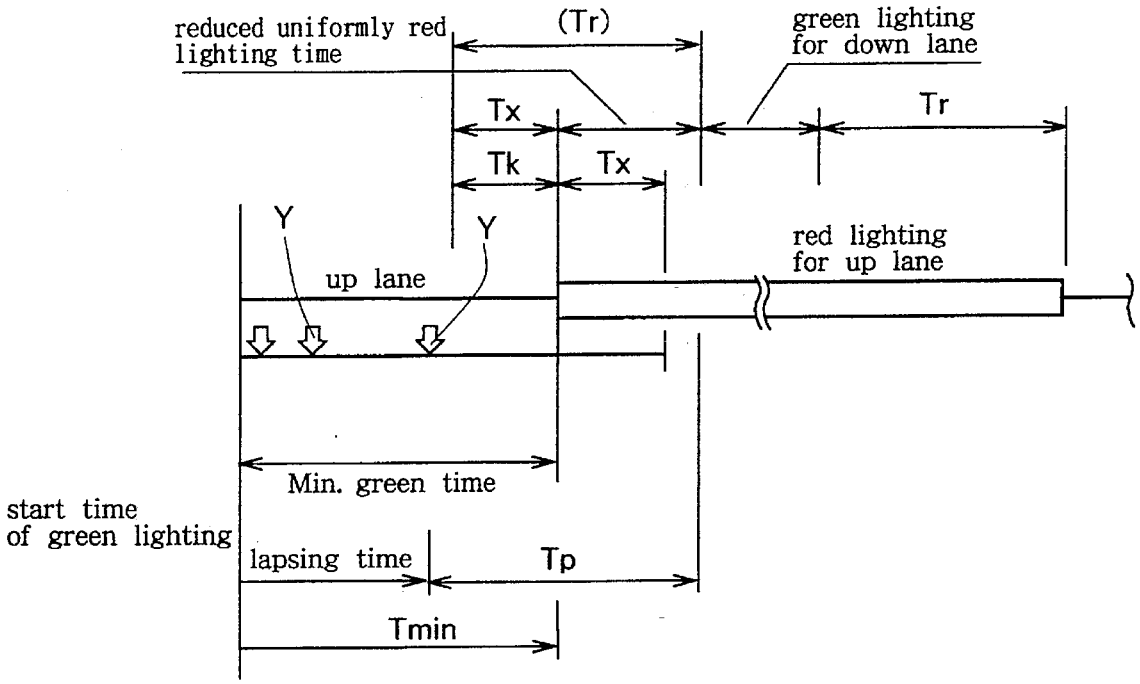
FIG. 15 is also an explanatory diagram showing a reduction of uniformly red time by means of a uniformly red time reduction means of a second embodiment of the invention.

FIGS. 14 to 15 explain the switching control of the traffic signal 6 or 7 within a time range from the minimum green time Tmin. under the maximum green time Tmax. with the aid of the uniformly red time reduction controller means 72.

Referring to FIG. 14, when detection signal at the right arrow Y is input because the last vehicle has entered the section 5 prior to the switching from green to red, and then there are no detection signals input into the lighting time controller 14 before the last unit extension time Te.lapses, the traffic signal 6 will change from green to red. Simultaneously with such switching, the clocking of the preset detection time Tx. starts, and with no detection signal input during the Tx., the uniformly red time Tr. is reduced by the preset detection time Tx., thereby executing the uniformly red lighting for the period obtained by subtracting the preset Tx. from the uniformly red time Tr.. It should be noted here that in such case, since the last vehicle had entered the section 5 at the right arrow Y the unit extension time Te. prior to the switching from green to red, the last vehicle still can pass through the section 5 in spite of such reduction of the uniformly red time Tr. by the time Tx. In other words, as the time of grace Tp. for the last vehicle is as long as the uniformly red time Tr. in FIG. 14, the last vehicle can safely pass through the section 5 in spite of such reduction.

Likewise, referring to FIG. 15, wherein no vehicles pass the section 5 during the switch holding time Tsh. and the traffic signal 6 switches from green to red with the aid of the lighting time controller 14 after lapse of the minimum green time Tmin. As shown in FIG. 15, as the switching from green to red immediately after lapse of the Tmin. will occur when the last vehicle enters the section 5 prior to the switch holding time Tsh, the time of grace for the last vehicle Tp. will be longer than the uniformly red time Tr., thus allowing the last vehicle to safely pass through the section 5. As the above described, according to this embodiment, the uniformly red lighting time Tr. can be reduced, without damaging the safety passage of vehicles, whereby the system for traffic signals can be free from so-called loss time corresponding to the preset detection time Tx., thus allowing vehicles from both directions to smoothly pass the section 5.

Figure 16:
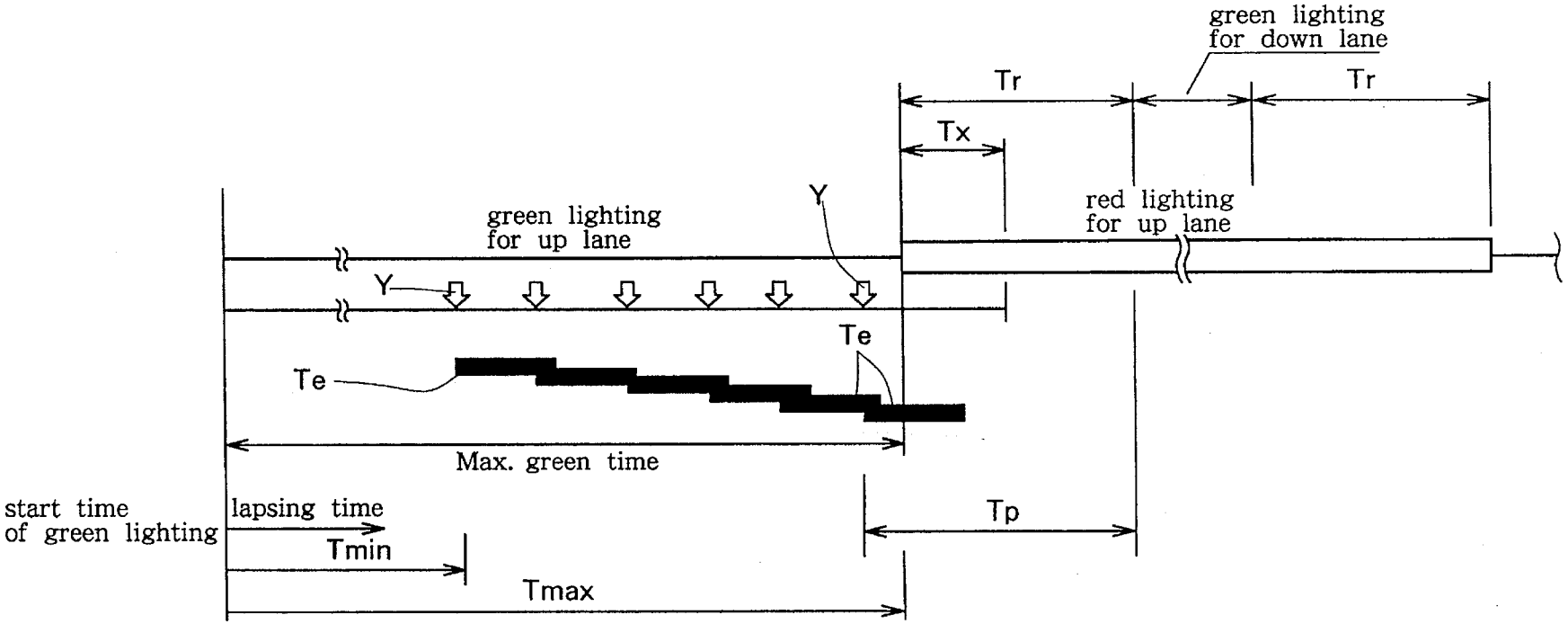
FIG. 16 is an explanatory diagram in which a green lighting time has amounted to a max. greem time in a second embodiment of the invention.

Further, it should be noted that the uniformly red time reduction controller means 72 is actuated under the maximum green time Tmax.. Referring to FIG. 16, it refers to the switching from green to red after lapse of the Tmax., wherein green lighting time is extended by the unit extension time Te. by the passage of the last vehicle designated by the detection signal input at the right arrow Y. If the green lighting time amounts to the Tmax., the traffic signal 6 will change from green to red by means of the lighting time extension controller 14. In such case, while the clocking of the preset detection time Tx. will start with the aid of the lighting time controller means 14, the uniformly red time reduction controller means 72 is actuated under the Tmax, whereby the uniformly red time Tr. will not be reduced with no vehicles passing during the clocking of the Tx.. Accordingly, the time of grace Tp for the last vehicle can be longer than the uniformly red time Tr. in FIG. 16, thus allowing the last vehicle to safely pass through the section 5.

Figure 17:
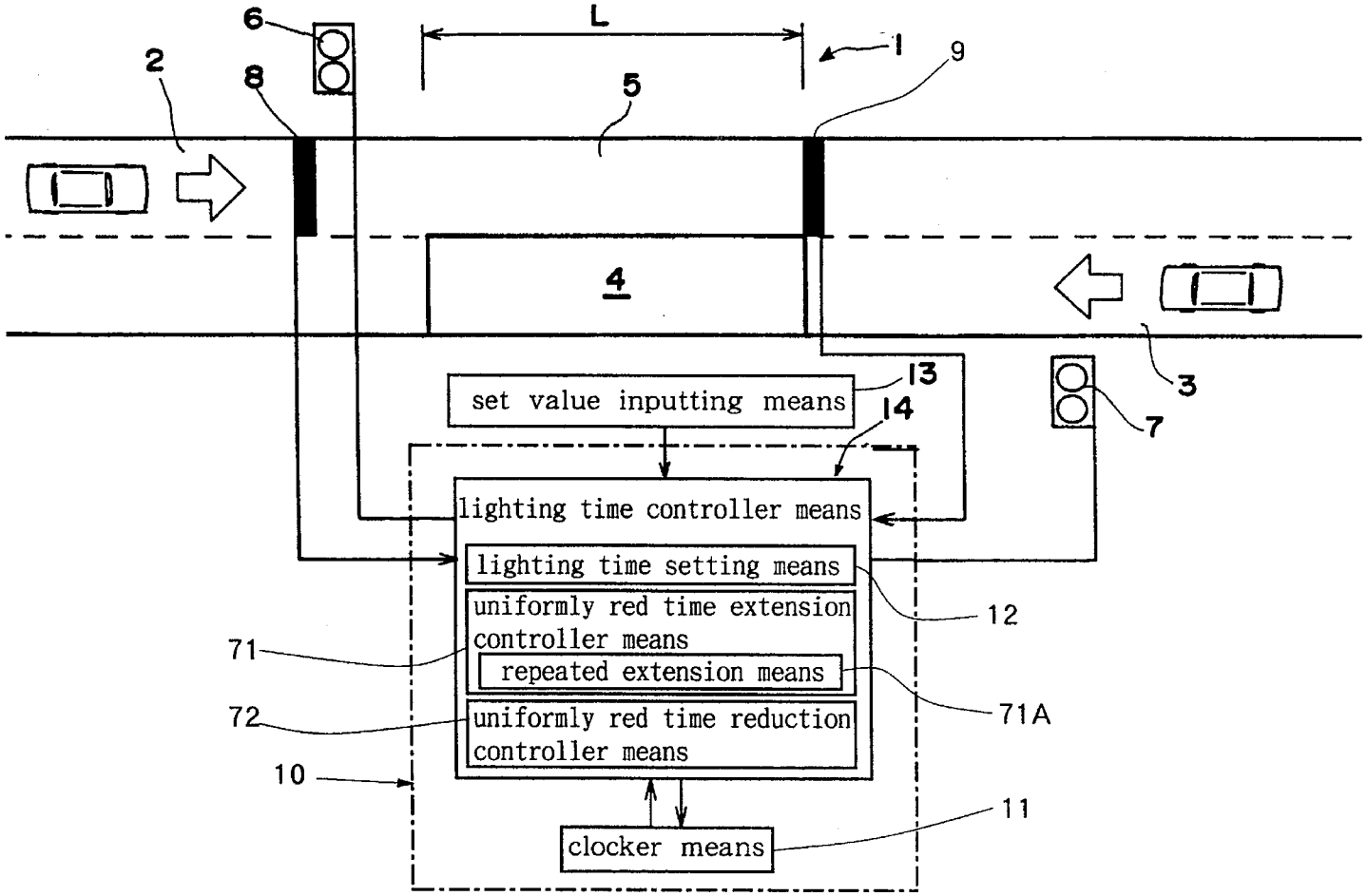
FIG. 17 is an explanatory plan view and diagram showing a third embodiment of the invention.
Figure 18:
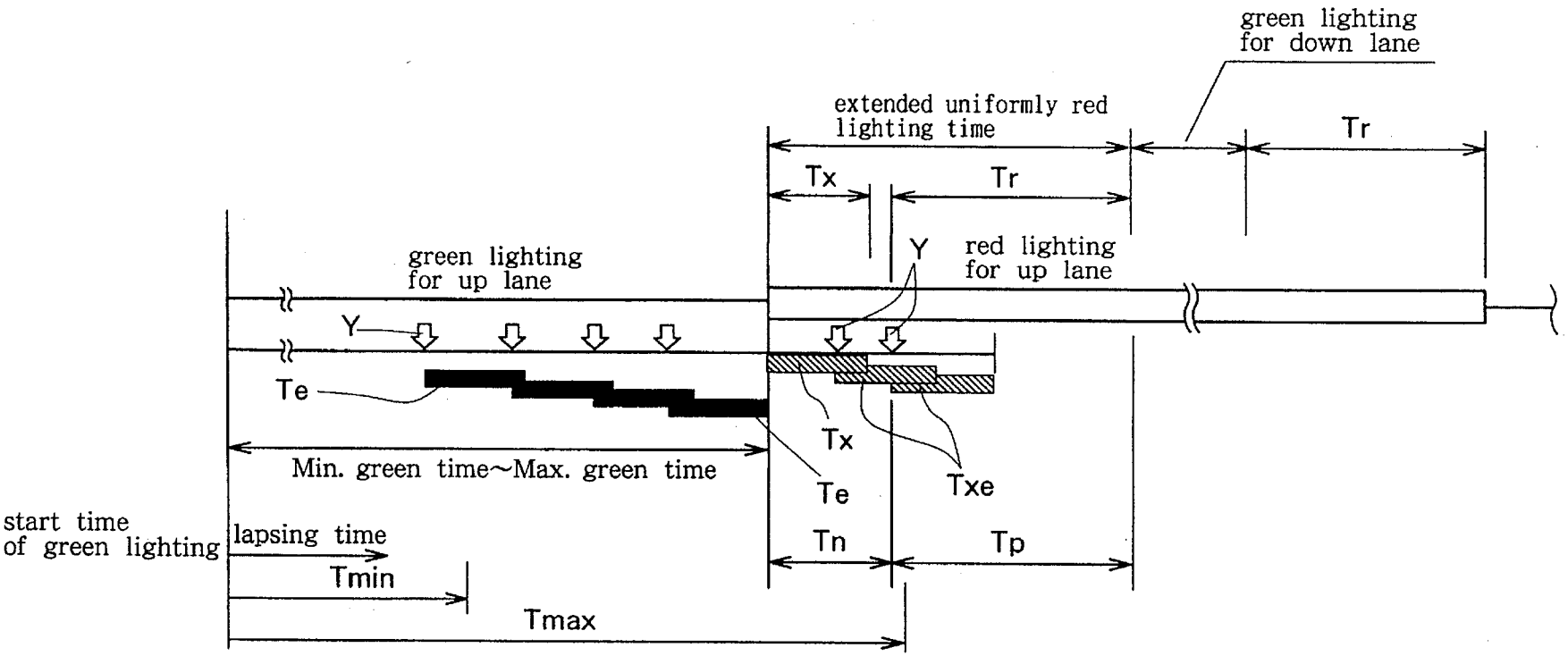
FIG. 18 is an explanatory diagram in which a uniformly red lighting time has been extended by a uniformly red time extension controller means having a repeated extension means of a third embodiment of the invention.
Figure 19:
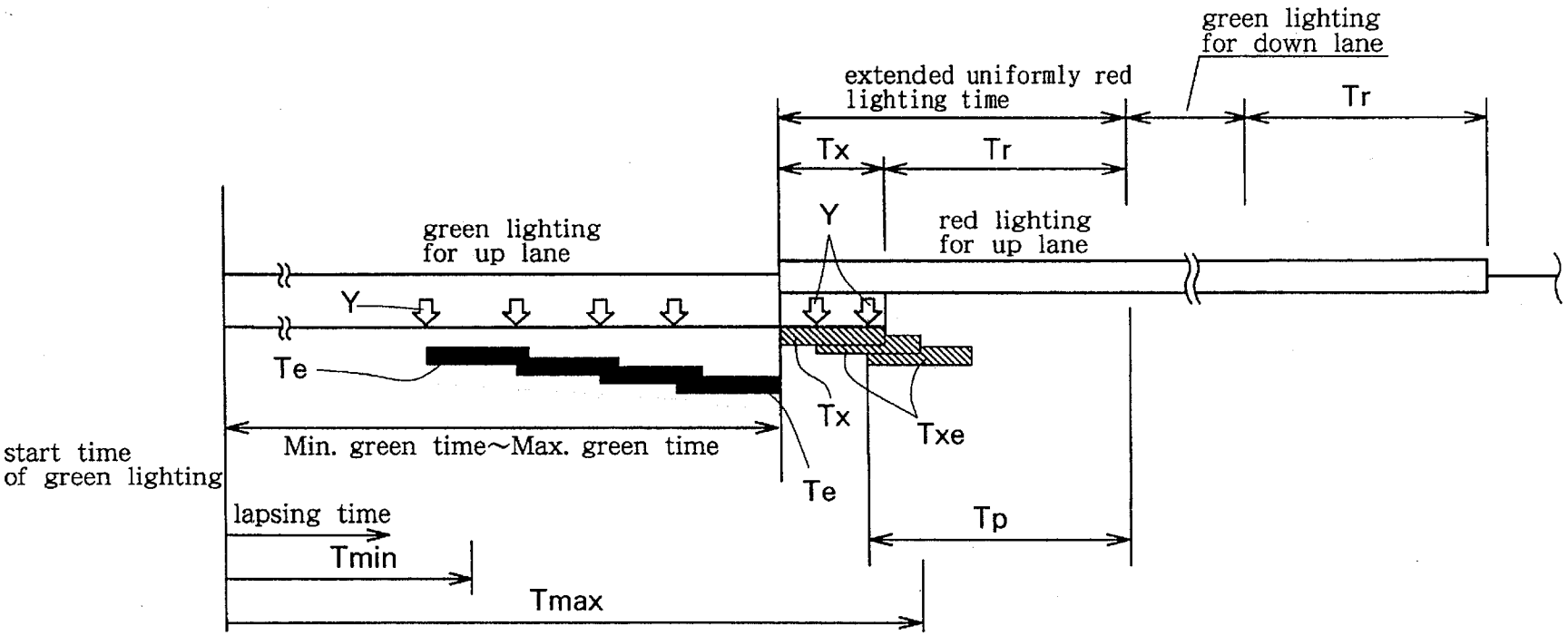
FIG. 19 is also an explanatory diagram in which a uniformly red lighting time has been extended by a uniformly red time extension controller means having a repeated extension means of a third embodiment of the invention.

In FIGS. 17 to 19 showing a third embodiment of the invention, the uniformly red time extension controller means 71 further comprises repeated extension means 71A, while the set value inputting means 13 is able to set the value of extension detection time Txe. during which any detection signals are to be input, and the number of repeated times of extension which is set without any restriction in this embodiment.

Owing to the uniformly red time extension controller means 71 having the repeated extension means 71A, with some detection signal input by either the detector means 8 or 9 of the traffic signal 6 or 7 during the preset Tx. after the swithing from green to red in respect of either the traffic signal 6 or 7, the uniformly red time Tr. is extended by the preset Tx., while the repeated extension means 71A extends the detection time by the extension detection time Txe. equal to the preset Tx., which is further extended by another Txe. upon input of another detection signal within the innitial extension detection time Txe. Such extention operation is repeated in the above manner. Whilst, if the traffic signal 6 or 7 switches from green to red within a time range from the Tmin. to Tmax., the clocking of the preset Tx. will start by means of the clocker means 11, and with the first detection signal input by the detector means 8 or 9 of either the traffic signal 6 or 7 which switches from green to red during the preset Tx., the uniformly red time Tr. will be extended by the Tx. from the time point of the first detection signal input, while by control of the repeated extension means 71A, the clocker means 11 will start to clock the first extension detection time Txe. upon the first input. Without any detection signals input during the first extension detection time Txe., the uniformly red time Tr. is extended by the preset Tx. as the first detection signal is input within the Tx., while with the second detection signal input during the first Txe., the clocking of the second extention detection time Txe. and waiting for another input will start in the same manner.

In the case of no restrictions in repect of the number of repeated times of the extension detection time Txe., the Txe. will be repeatedly extended in such a manner as three times, four times or above provided that there are detection signal inputs during the Txe., which can be repeated until the last Txe. within which no detection signals are input. Finally, with no detection signal input within the last Txe., the uniformly red lighting time will be extended by extention time Tn. defined as a time distance between the switching from green to red and the input of the last detection signal, provided that the preset detection time Tx lapses.

In FIG. 18 explaining the switching control of the traffic signal 6 or 7 within a time range from the Tmin, to the Tmax. with the aid of the uniformly red time extension controller means 71 having the repeated extension means 71A, wherein the traffic signal 6 for up lane switches from green to red by means of the lighng time controller means 14, and at the same time, the clocking of the preset Tx. will start.

With the first detection signal input at the arrow Y within the Tx. concerning vehicle passing against a red light, the uniformly red time Tr. will be extended by at least the preset Tx. owing to the uniformly red time extension controller means 71, thereby executing uniformly red lighting for the total time of the Tr. and Tx. Further, as there is also provided the repeated extension means 71A in this embodiment, with the above first detection signal input concerning vehicle passing against a red light, the clocking of the first Txe. will start, and with the second detection signal input at the right arrow Y in the drawing during the first Txe., the clocking of the second Txe., and waiting for another detection signal will start in the same manner. Specifically in FIG. 18, as there is no detection signal input within the Txe. after the second detection signal, the extension time Tn. defined as a time distance between the switching from green to red and the input of the second or last detection signal will be added to the uniformly red lighting time. Accordingly, if other second or third vehicles enter the section 5 subsequently to the first vehicle passing against a red light, the time of grace Tp. for the last vehicle will be still equal to the uniformly red time Tr. as shown in FIG. 18, thus allowing a plurality of vehicles entering the section 5 against a red light after the switching to red to safely pass therethrough.

FIG. 19 shows an exmaple in which the uniformly red time extension controller means 71 extends the uniformly red time Tr. by at least the preset Tx., thus executing the uniformly red lighting for the total time of the Tr. and the Tx.. Even if the first or second detection signals at arrows Y are input during the preset Tx. and then, by control Of the repeated extension means 71A, the clocking of the first and second extension detection time Txe. and the waiting for another detection signal start, the uniformly red lighting time will be only extended by the Tx. only with such inputs within the preset Tx.. In other words, the extension of uniformly red lighting time by means of the repeated extension means 71A is only executed by the detection signal after lapse of the preset Tx..

According to this embodiment, the uniformly red time extension controller means 71 further comprises the repeated extension controller means 71A, which extends the detection time by the extension detection time Txe. equal to the preset Tx. with detection signal input within the preset Tx., which is repeatedly extended by each Txe. equal to the preset Tx. with every input detection signal input within the Txe., or extends the uniformly red lighting time by the extension time Tn defined as a time distance between the switching from green to red and the input of the last detection signal without any detection signals within the Txe., whereby the uniformly red time can be extended by the preset Tx. if some vehicles enter the section 5 agaist a red light immediately after the switching from green to red. At the same time, the detection time will be extended by the Txe. upon input of the first detection signal concerning vehicle passing against a red light, which is further extended by the Txe. with another detection signal within the extension detection time Txe..

To summarize the above operation, the detection time will be repeatedly extended by the Txe. with every input of the detection signal within every Txe., while with no detecton signal within the Txe., the uniform red lighting time will be extended by the totaled extension detection time Txe. limited by the last detection signal input. Consequently, as shown in FIG. 18, the time of grace Tp for the last vehicle will be equal to the uniform red time Tr., thus preventing the opposite traffic signal from swithing to green until it safely passes through the section 5, so that if other vehicles are induced by the first violator vehicle or subsequently enter the section 5, such vehicles can safely pass through the section 5.

Figure 20:
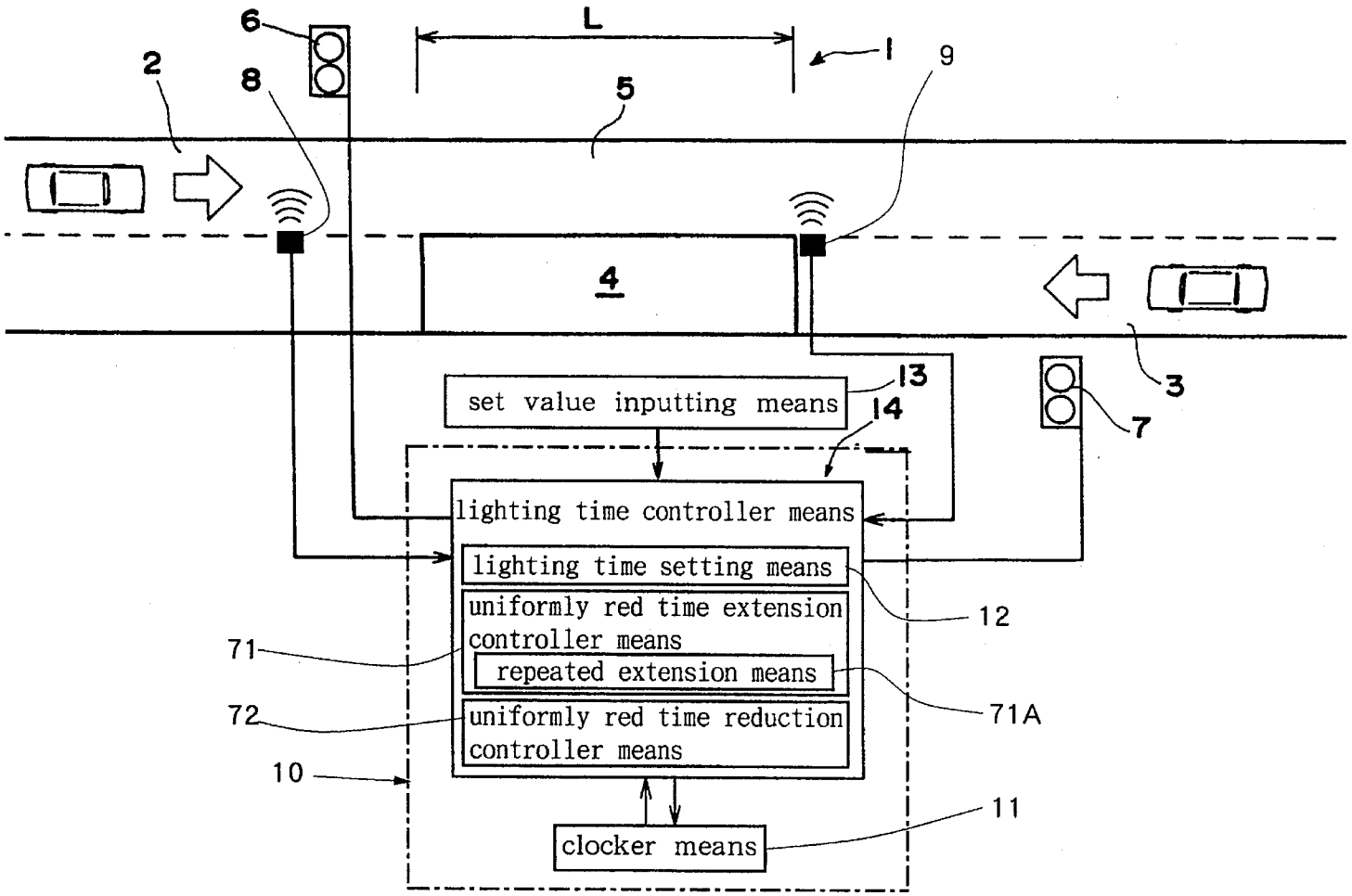
FIG. 20 is an explanatory plan view and diagram showing a fourth embodiment of the invention.
Figure 21:
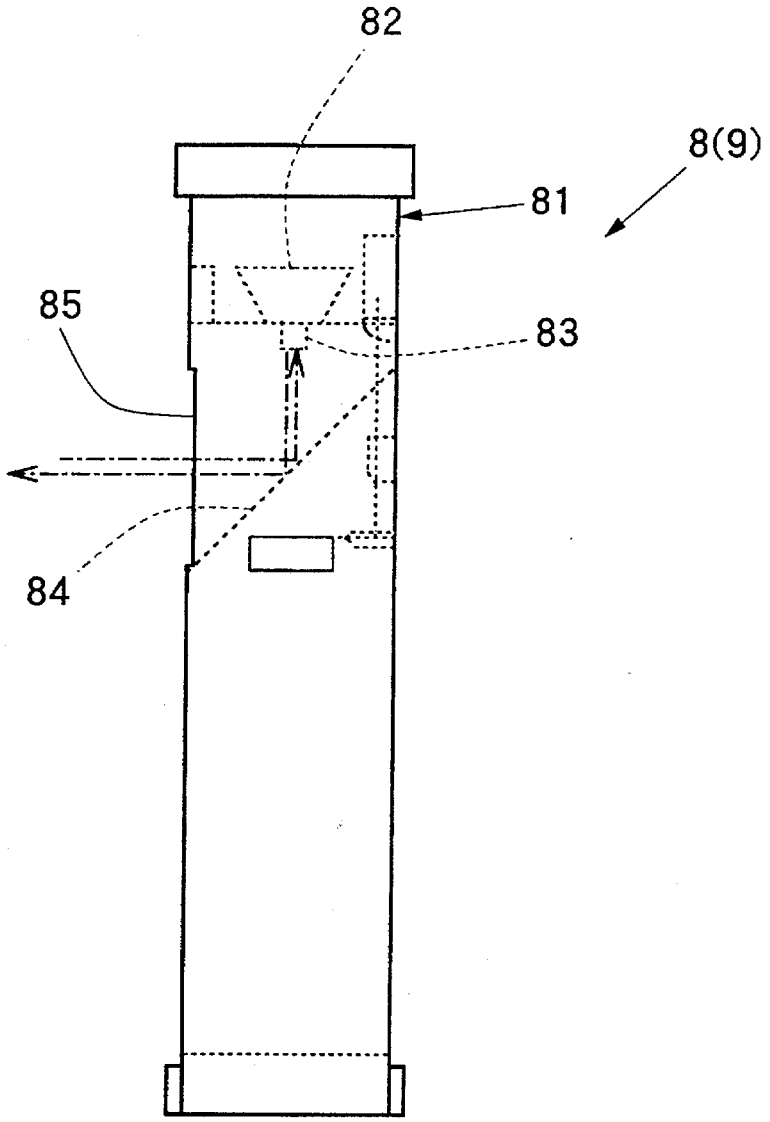
FIG. 21 is a side view showing an ultrasonic wave sensor of a fourth embodiment of the invention.

In FIGS. 20 to 21 showing a fourth embodiment of the invention, ultrasonic wave sensors are employed for the detector means 8 and 9. As shown in FIG. 21, the ultrasonic wave sensors has main body 81 integrated with ultrasonic wave transmitter and receiver 82 thereabove, thus propagating ultrasonic wave downward from the transmitter and receiver 82. The propagated ultrasonic wave will be reflected on reflecting surface 84 obliquely provided in a lower portion, and then, travel through front aperture 85 and be reflected on vehicles. Finally, the reflected wave will be received by the receiver 83 to detect the passing of vehicles.

Incidentally, the invention should not be limited to the forgoing embodiments, but can be modified within a scope of the invention. For example, the detector means may be suitable sensors other than those in the embodiment as long as they can detect the passing of vehicles from up and down lanes. Further, if there is little traffic in one lane, the maximum green time for the opposite traffic signal in the other lane may be extended. Furthermore, in case of electric power failure occurring in each embodiment, the function of the system may be maintained for example for nearly 30 minutes by means of integrated battery (not shown).

What is claimed:

1. A system for traffic signals for one-side passing, comprising:

two-position signals temporalily provided at both ends of a road reparing section through which vehicles from up lane and down lane alternately pass;

detector means for detection of passage of vehicles which are provided at both ends of the road reparing section, each corresponding to each traffic signal;

a sensitive controller device for control of green or red lighting time and switching of red or green indication of the traffic signals based upon detection signals by the detector means, said sensitive controller being provided for cycled lighting of the traffic signals, said one cycle consisting of green-red, red-red, red-green and red-red lighting in sequence of each traffic signal;

a uniformly red time extension means for extending the uniformly red time by a preset detection time if detection signal is input by the detector means of one traffic signal switching from green to red by the sensitive controller device within the preset detection time after such switching.

2. A system for traffic signals for one-side passing according to claim 1, wherein said sensitive controller device comprises:

a lighting time setting means by which minimum and maximum green time of the traffic signals can be set;

a lighting time controller means which extends green lighting time by unit extension time with input of detection signal concerning the vehicles within a switch holding time prior to lapse of the minimum green time, and further extends the green lighting time by the unit extension time up to the maximum green time with another input of detection signal within the unit extension time, said lighting controller means allowing the green light to switch to red after lapse of the minumum green time without any input of detection signals concerning the vehicles within the switch holding time prior to lapse of the minimum green time, and likewise, said lighting controller means also allowing the green light to switch to red after lapse of the unit extension time without any input of detection signals during the unit extension time;

a uniformly red time extension means for extending the uniformly red time by a preset detection time if detection signal is input by the detector means of one traffic signal switching from green to red by the lighting time controller means within the preset detection time after the traffic signal switches from green to red within the maximum green time after the minimum green time.

3. A system for traffic signals for one-side passing according to claim 1, wherein said sensitive controller device comprises:

a lighting time setting means by which minimum and maximum green time of the traffic signals can be set;

a lighting time controller means which extends green lighting time by unit extension time with input of detection signal concerning the vehicles within a switch holding time prior to lapse of the minimum green time, and further extends the green lighting time by the unit extension time up to the maximum green time with another input of detection signal within the unit extension time, said lighting controller means allowing the green light to switch to red after lapse of the minumum green time without any input of detection signals concerning the vehicles within the switch holding time prior to lapse of the minimum green time, and likewise, said lighting controller means also allowing the green light to switch to red after lapse of the unit extension time without any input of detection signals during the unit extension time;

a uniformly red time reduction means for reducing the uniformly red time by a preset detection time if detection signal is not input by the detector means of one traffic signal switching from green to red by the lighting time controller means within the preset detection time after the traffic signal switches from green to red under the maximum green time after the minimum green time.

4. A system for traffic signals for one-side passing according to claim 2, wherein said uniformly red time reduction means is integral with the sensitive controller device.

* * * * *

UNITED STATES PATENT AND TRADEMARK OFFICE

CERTIFICATE OF CORRECTION

PATENT NO. : 5,610,599

DATED : March 11, 1997

INVENTOR(S) : Nomura et al.

It is certified that error appears in the above-indentified patent and that said Letters Patent is hereby corrected as shown below:

Table 1, columns 7-8, lines 15-16, underneath the subheading "operation" delete "before shifting".

Table 1, column 7, on the left side of Table 1, lines 26-27, insert --before shifting--.

Column 11, line 15, replace "Leans" with --means--.

Signed and Sealed this

Twelfth Day of August, 1997

Bruce Lehman

*Attest:*

BRUCE LEHMAN

*Attesting Officer*

*Commissioner of Patents and Trademarks*